US006864847B2

(12) United States Patent
Wensink

(10) Patent No.: US 6,864,847 B2
(45) Date of Patent: Mar. 8, 2005

(54) SYSTEM FOR REMOTELY ADJUSTING ANTENNAS

(76) Inventor: Jan Blair Wensink, P.O. Box 2386, Lake Elsmore, CA (US) 92647

( * ) Notice: Subject to any disclaimer, the term of this patent is extended or adjusted under 35 U.S.C. 154(b) by 175 days.

(21) Appl. No.: 10/080,843

(22) Filed: Feb. 22, 2002

(65) Prior Publication Data

US 2003/0160731 A1 Aug. 28, 2003

(51) Int. Cl.[7] ..... H01Q 3/00

(52) U.S. Cl. ..... 343/760; 343/765; 343/894; 342/359

(58) Field of Search ..... 343/757, 760, 343/890–892, 894, 765, 766, 852; 342/359

(56) References Cited

U.S. PATENT DOCUMENTS 5,029,799 A 7/1991 Bernier
5,461,935 A 10/1995 Hill
5,486,835 A * 1/1996 Hock ..... 342/359
5,583,514 A 12/1996 Fulop
5,952,980 A * 9/1999 Boling ..... 343/766
5,963,179 A 10/1999 Chavez
6,232,928 B1 5/2001 Zimmerman
6,239,744 B1 5/2001 Singer et al.
6,583,763 B2 * 6/2003 Judd ..... 343/890

* cited by examiner

*Primary Examiner*—Michael C. Wilmer
(74) *Attorney, Agent, or Firm*—Averill & Varn

(57) ABSTRACT

This invention describes a method, an apparatus, and a system for optimizing antenna performance by remotely adjusting the plumb-to-level (absolute measurements with respect to true vertical) and the compass heading (absolute compass heading direction with respect to magnetic North) of one or a plurality of communication antennas by electromechanical means. Until now, only fixed, manual adjustments referenced to points on the tower that are assumed to be accurate, but are not, can be made. Furthermore, antenna optimization that is accomplished by solely adjusting the tilt of an antenna is limited. And, since azimuth adjustments for antenna sectors are difficult to adjust manually and are not available by electromechanical means, site planning personnel have not been able to accurately compensate for changes in tower and site parameters. Also, since site surveys provide plumb-to-level and compass heading information, this invention allows remote adjustments of site parameters with absolute reference to survey data. Furthermore the invention allows antennas within a sector having antennas with capacity to spare to be swept into a sector experiencing higher traffic loads.

20 Claims, 23 Drawing Sheets

SYSTEM FOR REMOTELY ADJUSTING ANTENNAS

CROSS REFERENCE TO RELATED APPLICATIONS

None

STATEMENT REGARDING FEDERALLY SPONSORED R & D

None

REFERENCE TO A "MICROFICHE APPENDIX"

None

BACKGROUND OF THE INVENTION

1. Field of the Invention

This invention describes a method, an apparatus, and a system for remotely adjusting by mechanical and electronic means the plumb-to-level and the compass heading of one or a plurality of communication antennas. The term plumb-to-level will be used throughout this description to represent absolute measurements with respect to true vertical. And, the term compass heading will be used throughout this description to represent absolute compass heading direction with respect to magnetic North.

A continuing problem for cellular telephone network planners is that of base station over or under coverage. That is, if the overlapping area between two cells is too large (i.e., over coverage), increased switching between the base station (handoff) occurs, which strains the system. Likewise, if the overlapping area between two cells is too small (i.e., under coverage), gaps in service, or nodes, will occur. There may even be interference with other cellular networks using the same, or nearby, operating frequencies. To minimize the over and under coverage effects, a cost effective means to precisely position the antenna remains a continuing challenge.

This invention is not limited to antennas for cellular telephone network use only, but since this is the largest use, we will use this application in the following description. In general, radio frequency antennas are described as having a radiation pattern that is referred to as being a horizontal pattern and a vertical pattern, with the former being referenced along the horizon, as would a compass heading, and the latter being referenced from the vertical, as would plumb-to-level. Since cellular telephone traffic tends to concentrate in certain areas such as along a busy highway, further performance optimization is accomplished by the ability to precisely position the antenna in a concentrated area.

The industry term for antenna position with respect to vertical angle is down-tilt. The term for antenna position with respect to horizontal angle is azimuth. Measurements of plumb-to-level (P-L) and compass heading (CH) are absolute and are referenced to the earth itself. Current methods for obtaining antenna settings such as down-tilt angle are measured with respect to a part of the tower itself. In the case of most radio antennas, this measurement is made with respect to the tower. However, these tower referenced measurements are subject to many induced errors caused by weather, ground shifting, disturbances, or human error that is inherent to the measurement process itself. Once the reference is flawed, then all the calibrations based upon the reference are in error.

There are several ways to adjust antenna down-tilt. One way is to adjust it electronically by using a phased-array antenna. Another way is by mechanical means, as in using a special down-tilt mounting bracket such as the EZ-Tiltz™ bracket. The mechanical method is the simplest method since it does not require sophisticated timing and electronic phasing circuits. A third way to adjust the antenna down-tilt is to use closed loop electromechanical control devices using encoders. Because of the reference issue described above, this method is also flawed, and care must be taken to use components that are compatible with electromagnetic interference (EMI) sensitive communication electronics. The use of high frequency devices such as stepping motor drives is not recommended.

Unfortunately, antenna optimization that is accomplished by solely adjusting the down-tilt alone is limited. Improvements made by adjusting the down-tilt are only valid for one direction of the horizontal radiation pattern. Within the most critical range of down-tilt, the actual radiation coverage varies more according to the azimuth direction, but demonstrates that both the down-tilt and the azimuth adjustments are integral. A change results in a horizontal radiation half-power beam width which gets broader with increasing down-tilt angle rather than the desired narrower, more focused radiation beam. Since azimuth adjustments for antenna sectors (more than one antenna acting as one antenna) are difficult to adjust manually and are not available electronically, site planning personnel to date have not been able to accurately compensate for this effect. Site surveys provide P-L and CH information. Until now, only fixed, manual adjustments referenced to points on the tower are assumed to be accurate. This invention allows remote adjustments with absolute reference to survey data.

Cellular telephone network antenna systems found in the center of a "cell" usually consist of three sectors, positioned at 120° segments of the complete circle. Each sector usually consists of four antennas mounted on a common mounting bar. From this, it can be seen that a typical cellular telephone antenna site can have up to twelve antennas needing periodic adjustment. This is very labor intensive and expensive, and usually involves dangerous work high above the ground.

2. Description of Related Art

Singer et al., U.S. Pat. No. 6,239,744 B1, teaches a method for adjusting antenna down-tilt, but only from a broad-brush perspective. Singer fails to address the need for azimuth adjustments in order to optimize beam coverage of a specific location when consideration is given to traffic patterns, topography, and other networks. Further, the Singer patent is based on the use of built-in controllers for each antenna and antenna sector, remembering stored data, and utilizing local and remote displays. In Singer, sensing down-tilt position of the antenna is left to an angle decoder to determine the angle between the antenna and its mounting structure, but does not address the need to coincide site survey data and actual site conditions. Much attention is given to operational function in Singer, but little attention is given to indicate how the actual hardware, or any integrated system, may be created by following its teachings.

Zimmerman et al., U.S. Pat. No. 6,232,928, Bernier, U.S. Pat. No. 5,029,179, and Chavez, U.S. Pat. No. 5,963,179, all teach manually adjusted down-tilt or azimuth antenna brackets. No mention of a remote means of adjustment is made.

Fulop, U.S. Pat. No. 5,583,514, teaches a satellite antenna position optimization system that is fast, complicated and expensive, suitable for government satellite tracking, but not suitable for low cost commercial installations such as that required by small cellular antenna sites. Fulop teaches a method of using GPS data to establish antenna position, which is outside the scope of this invention.

Hill, U.S. Pat. No. 5,461,935, teaches a slip clutch linear actuator. This design is fatally flawed because over travel of the actuator could cause the mechanism to bind. With the spring loaded clutch, actuators are limited to a fixed amount of torque. If this torque limit is exceeded, the drive reaches a point of slippage, thereby causing an irreversible jamming condition due to limited torque settings of the slip clutch.

SUMMARY OF THE INVENTION

Objective and Advantages

This invention addresses the disadvantages of current equipment and techniques, and provides the industry with an economical and efficient method of making remote P-L and CH adjustments of multi-antenna sectors typically found at cellular telephone networks.

In a typical cellular telephone network, base station performance deteriorates quickly due to over coverage and under coverage. It is the objective of this invention to provide a method and a hardware/software system to effectively optimize cellular network antennas by remotely adjusting antenna P-L and CH to eliminate over coverage and under coverage.

Antenna adjustments that are referenced to the support structure such as Singer are subject to many errors caused by weather, ground shifting, or disturbances due to the measurement process itself. Once the reference is flawed, then all the measurements based on that reference become corrupted. It is the objective of this invention to provide measurements and adjustments of down-tilt and azimuth that are made with respect to absolute geodetic measurements of P-L and CH.

Antenna site survey data is based on absolute P-L and CH information To date, only fixed, manual adjustments of antenna down-tilt and azimuth can be made. It is the objective of this invention to provide a method for remote adjustments and measurements based on the same frame of reference.

Current methods of down-tilt adjustment of antennas by elaborate electronic means are limited and expensive. It is the objective of this invention to provide an electromechanical method of not only P-L adjustment, but also of CH adjustment by a simple, cost effective means that does not require sophisticated timing and electronic phasing circuits.

Due to the sensitive nature of communications circuits, extreme care must be taken to use components that are compatible with their electromagnetic interference (EMI) sensitive circuits. The use of devices that emit high frequency interference such as stepping motor drives is not recommended. It is the objective of this invention to construct a remote antenna P-L and CH adjustment system using reliable, EMI free, motors and drives. Additionally, the invention of this application teaches a technique for preventing actuator damage by utilizing reversing relay limit switches.

Since convenient azimuth adjustments for antenna sectors (an array of more than one antenna acting as one antenna) are difficult to adjust manually, and until now are not available electronically, site planning personnel have not been able to take this problem into consideration. It is the objective of this invention to provide a simple, low cost and remote method for making CH adjustments without having personnel climb to the top of towers or other similar structures.

Since up to twelve antennas may make up a typical cellular antenna site, with all needing periodic adjustment, manually making down-tilt and azimuth adjustments is very labor intensive and expensive, and usually involves dangerous work high above the ground. It is the objective of this invention to improve and simplify the process of remotely and quickly adjusting antenna P-L and CH, with economical, cost effective hardware, and without the need for personnel to climb any towers or similar structures.

Systems that provide on site power and control of antenna adjustments may experience occasional tampering or interference by stray electrical transients. It is the objective of this invention to provide a secure, cost effective solution to the antenna adjustment requirement by providing a system that does not require on site power and computing or controlling capability. Additionally, one set of equipment may be used on many antenna sites by a single technician.

The details and many of the advantages provided by this invention will become clear and will be better understood by reviewing the following description and accompanying drawings, wherein: the preferred embodiment offers a system for remotely adjusting the P-L and CH of one or a plurality of communication antennas.

DETAILED DESCRIPTION

Figure 1:
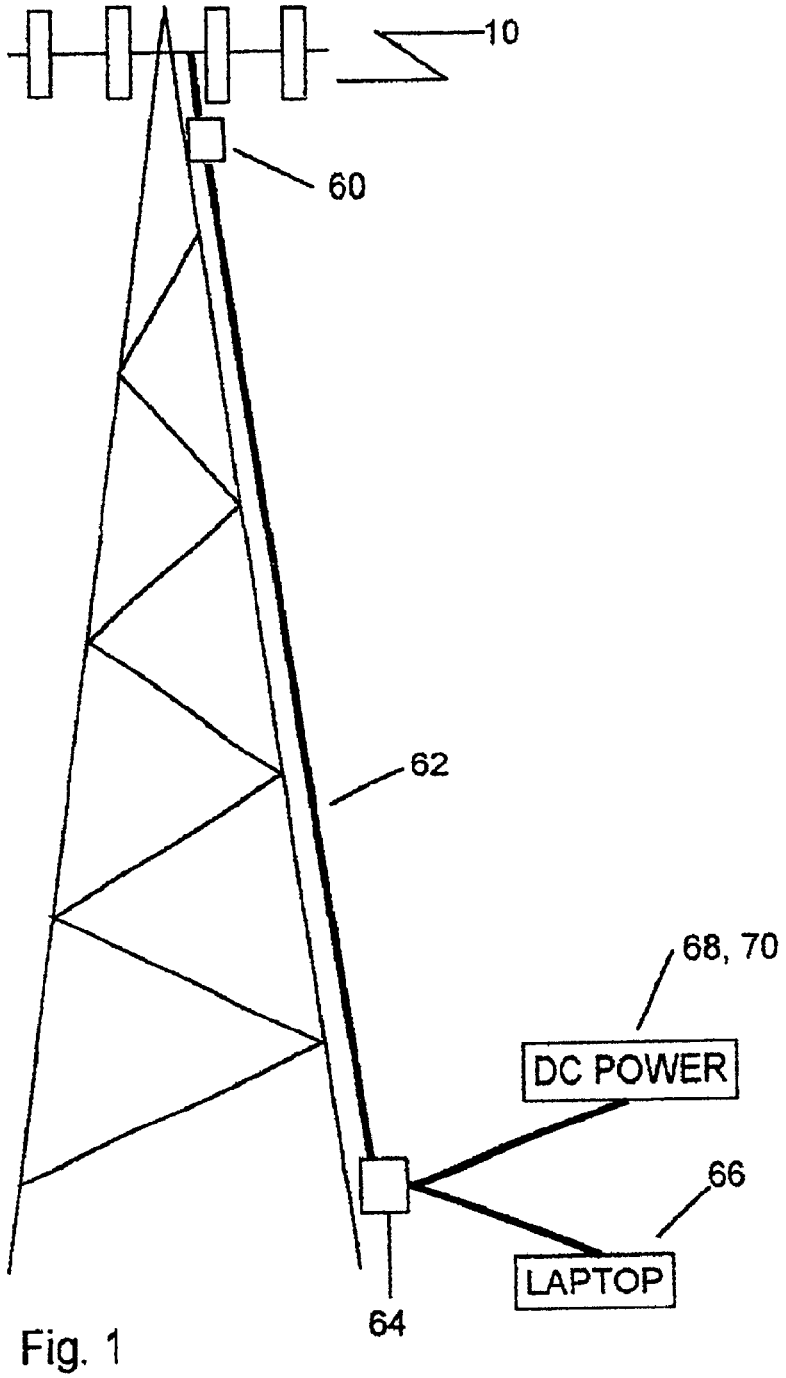
FIG. 1 is a typical antenna sector mounted atop a tower showing major components of the invention

FIG. 1, shows a communications antenna system having, typically, four duplex transmitting and receiving cellular antennas mounted as a sector atop a suitable structure such as, for example, a tower. Furthermore, each cellular system tower may have up to three such sectors, each sector covering a segment that is usually ⅓ of a circle (120°). Referring to FIG. 1, a system for remotely adjusting the P-L and CH of one or a plurality of communication antennas, the subject of this invention is shown comprising: an antenna sector optimizer 10, mounted atop a tower, one or more weatherproof field interconnection boxes 60 and 64, an interconnection cable 62 running between the field boxes, one or more DC power sources 68 and 70, and a laptop computer 66. Although four antennas are shown to represent a sector in FIG. 1, this is not intended to be a limitation in scope, as one or a plurality of antennas may comprise a sector as defined by this invention. It is within the scope of contemplation of the inventor that the tower might be a building, a wall, or other appropriate manmade or natural structure. Furthermore, there may be one or a plurality of field boxes used, even though FIG. 1 shows two boxes being used. The invention will work equally as well with one or many field boxes being used. Also, FIG. 1 identifies a wire cable as the interconnection cable 62, however, future technology might allow this cable to be fiber optic or other interconnection means. Although FIG. 1 shows two DC power sources, it is within the scope of contemplation that any suitable power source such as, but not limited to, AC line power, "green" power, generator power, or similar power sources, could power this system. And finally, even though FIG. 1 depicts a laptop computer, it is highly likely that a remote mainframe or desktop computer may also be utilized to practice this invention.

Figure 2:
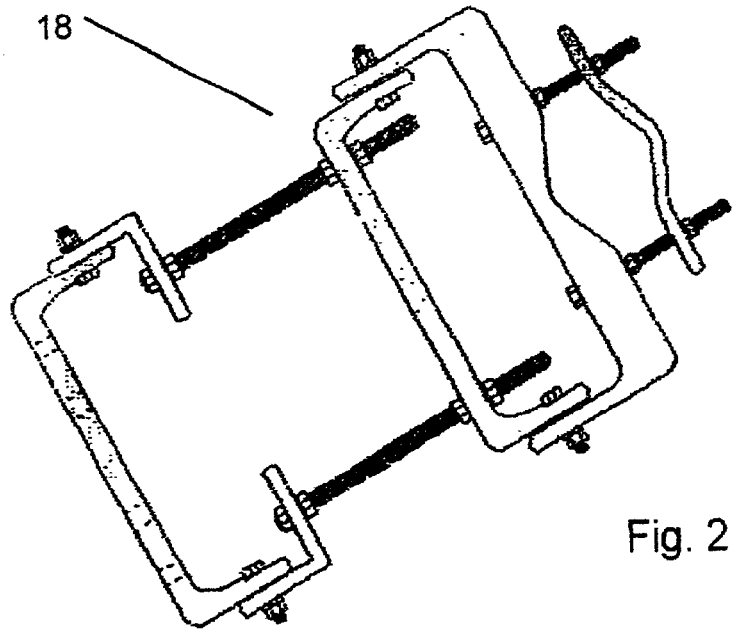
FIG. 2 is an upper bracket
Figure 2A:
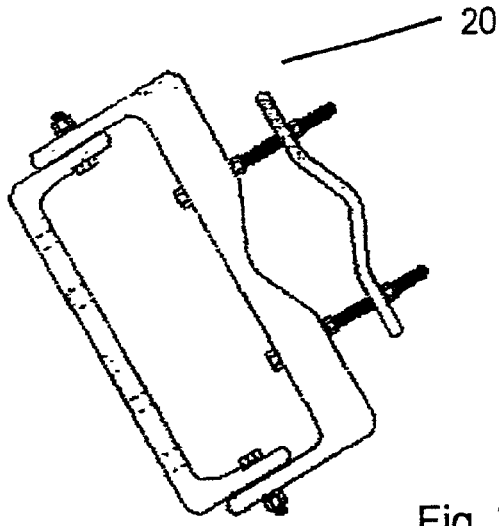
FIG. 2*a* is a lower bracket.

FIG. 2 depicts the upper down-tilt bracket 18. FIG. 2*a* depicts the lower down-tilt bracket 20.

Figure 3:
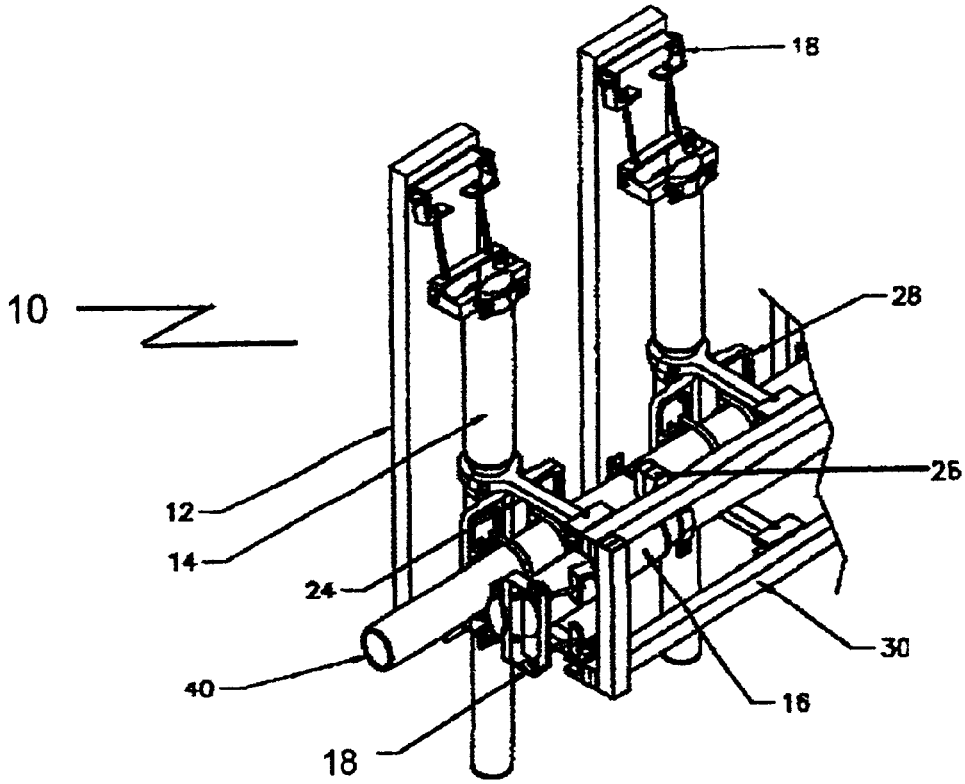
FIG. 3 is an antenna sector with P-L and CH actuators

FIG. 3 is a cutaway view of the antenna sector optimizer 10, showing two antennas making up the sector. Although FIG. 3 shows only two antennas making up the sector, it is within the scope of contemplation that any number of antennas may be used to make up the sector. The antennas 12 are firmly attached to the tower by way of a mounting bar 40, normally one of three positioned to form a triangle at the top of the antenna tower. These bars are welded to the tower thereby providing a fixed, rigid attachment. Each antenna 12 of the sector is attached to an individual electromechanical linear actuator hereinafter referred to as the P-L actuator 14. The preferred embodiment of this invention utilizes the EZ Actuator™ linear actuator, however, other suitable linear actuators may be used to practice this invention. The antenna 12 of the sector is attached to the P-L actuator 14 by an upper down-tilt bracket 18 and a lower down-tilt bracket 20 (FIG. 2 and FIG. 2*a*). Although the preferred embodiment of this invention utilizes the EZ Tiltz™ brackets, any other suitably configured tilt brackets may be used to practice this invention. Another key bracket is the actuator bracket 28. The P-L actuator 14 is attached to the mounting bar 40 by an actuator bracket 28 and to the antenna 12 using the upper down-tilt bracket 18 and the lower down-tilt bracket 20. The assembly of these components provides the tilt adjustment of the antenna sector optimizer 10.

Referring again to FIG. 3, in order to provide CH adjustment to the antenna 12, the antenna sector optimizer 10 is provided with an additional electromechanical linear actuator hereinafter referred to as the CH actuator 16. The preferred embodiment of this invention utilizes the EZ Actuator™ linear actuator, however, other suitable actuators, linear or otherwise, may be used to practice this invention. The CH actuator 16 is attached to the mounting bar 40 using a pair of U-bolt or universal fasteners 26 (only one is shown in the cutaway view). Each individual P-L actuator 14 is attached to a CH tie bar 30 through a pair of pitman arms 24. The CH tie bar 30 is attached to the top of the CH actuator 16 with an additional upper down-tilt bracket 18. The assembly of these components provides the CH adjustment of the antenna sector optimizer 10.

Figure 4A:
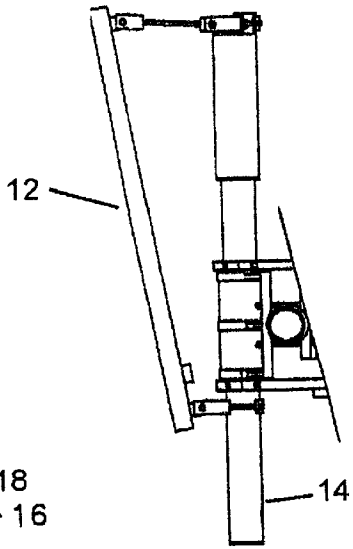
FIG. 4*a* is an antenna sector with P-L and CH, (cut away showing P-L at its maximum)
Figure 4:
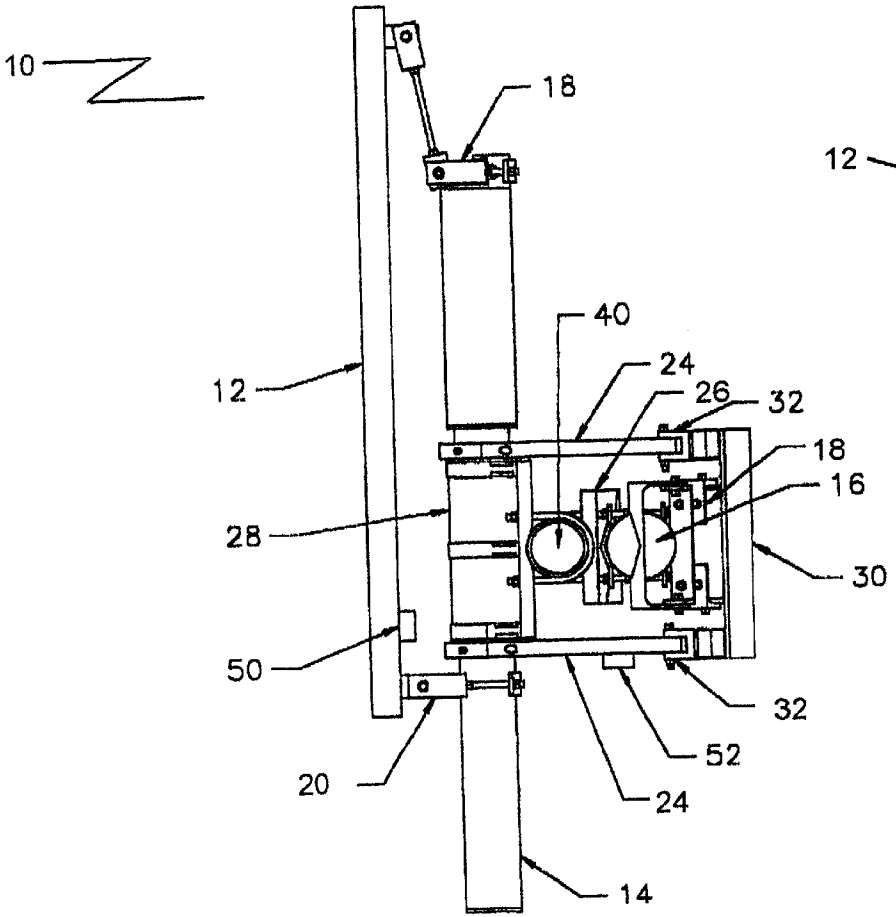
FIG. 4 is an antenna sector with P-L and CH positioners

FIG. 4 depicts an end view of the antenna sector optimizer 10 with the P-L actuator 14 in its minimum position and the antenna 12 in its least tilted position. A cutaway view, FIG. 4*a*, shows the same detail, but with the P-L actuator 14 in its extended position, and the antenna 12 in its full tilt position. FIG. 4 shows that the lower down-tilt bracket 20 has one hinged part, and is clamped to the lower half of the P-L actuator 14 at a fixed position. Further, FIG. 4 shows the lower down-tilt bracket 20 is bolted to the bottom area of the antenna 12. It shows that the upper down-tilt bracket 18 is hinged in two places, and is attached at the top of the P-L actuator 14 and to the top area of the antenna 12. This double hinge action makes the top of the antenna 12 tilt forward as the P-L actuator 14 is extending, and conversely, it makes the top of the antenna 12 tilt backward when it is contracting.

Continuing to refer to FIG. 4, the actuator bracket 28 is a casting or weldment forming a vertical surface having a tangentially positioned vertical tube on its back side. The P-L actuator 14 is inserted into the tube. Heavy grease is packed between the actuator and the inside of the tube as a means of dampening the rotational motion of the P-L actuator 14 caused by wind loading and other vibrational forces exerted on the antenna. The P-L actuator 14 is held vertically in place by a pair of pitman arms 24, one located above the tube and one located below the tube. The pitman arms 24 limit the up and down movement of the P-L actuator 14, and allow it to rotate with respect to the actuator bracket 28. The pitman arms 24 are in turn attached to a CH tie bar 30 using pitman arm attachment pins 32. Movement of the CH tie bar 30 causes all pitman arms to move such that the P-L actuators 14 attached to each and every antenna 12 in the sector rotate (change CH) together, thereby causing a uniform redirection of the antenna sector CH.

The CH tie bar 30 is attached to the CH actuator 16 by the upper tilt bracket 18. This bracket has two hinges and is the same as the upper tilt bracket 18 used to attach the antenna 12 to the P-L actuator 14. As the CH actuator 16 extends from its minimum length to its maximum length, the P-L actuators 14, and thereby, the antennas 12 rotate through their full sweep of CH rotation.

Also shown in FIG. 4, are the CH detector 52 and the P-L detector 50.

Antenna Sector P-L/CH Actuator

Figure 5:
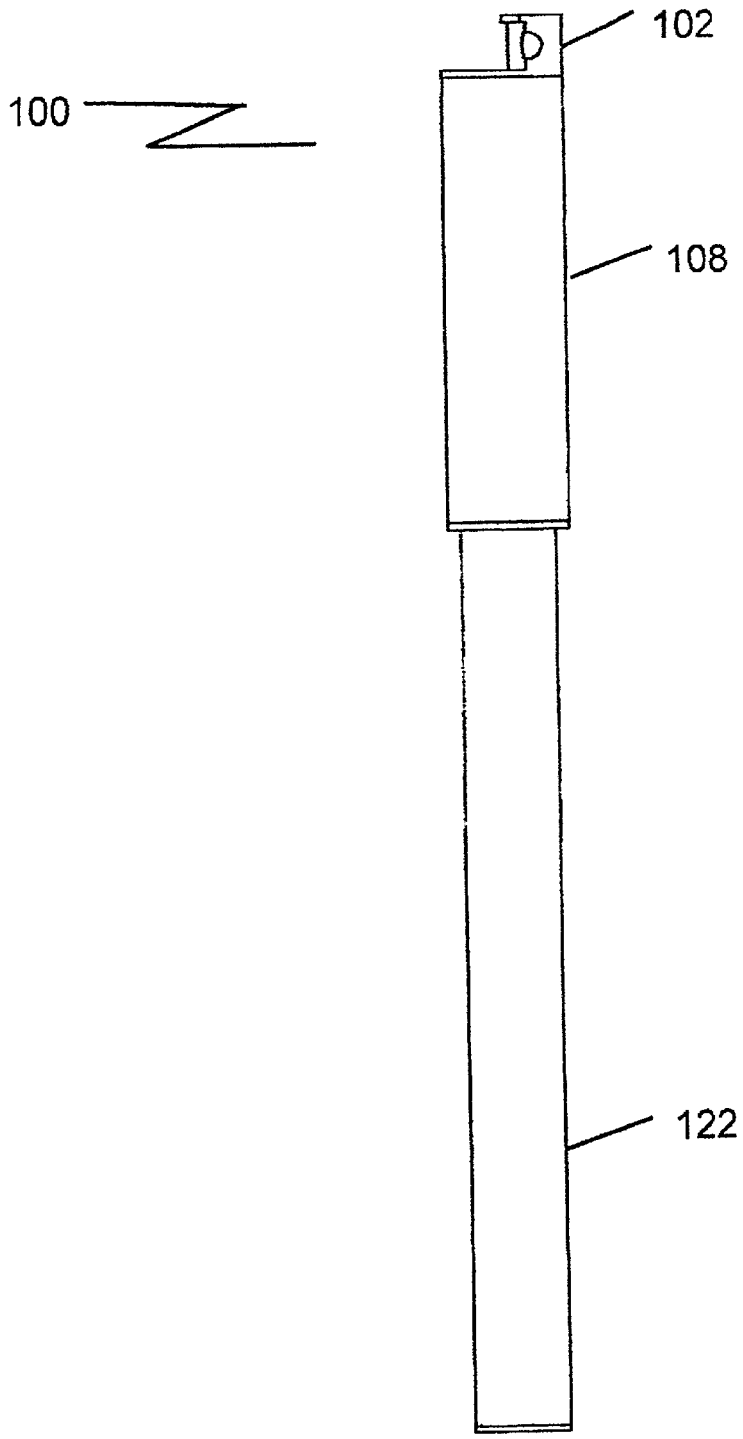
FIG. 5 is a linear actuator.

FIG. 5 shows a side view of an actuator 100 used in this invention for both the P-L actuator 14 and the CH actuator 16. Both of these actuators (14 and 16) are motor driven linear actuators. In this invention, the EZ Actuator™ linear actuator is used for the P-L actuator 14 and the CH actuator 16. It is within the scope of contemplation of this invention that other suitable linear actuators may be used.

The actuator 100 comprises three main parts, the actuator crown 102, the dust shield 108, and the main body extrusion 122. During normal operation, power being applied to the internal motor, (as described below) causes the linear actuator to increase or decrease its length, and the distance between the actuator crown 102 and the main body extrusion 122 changes accordingly.

Figure 5A:
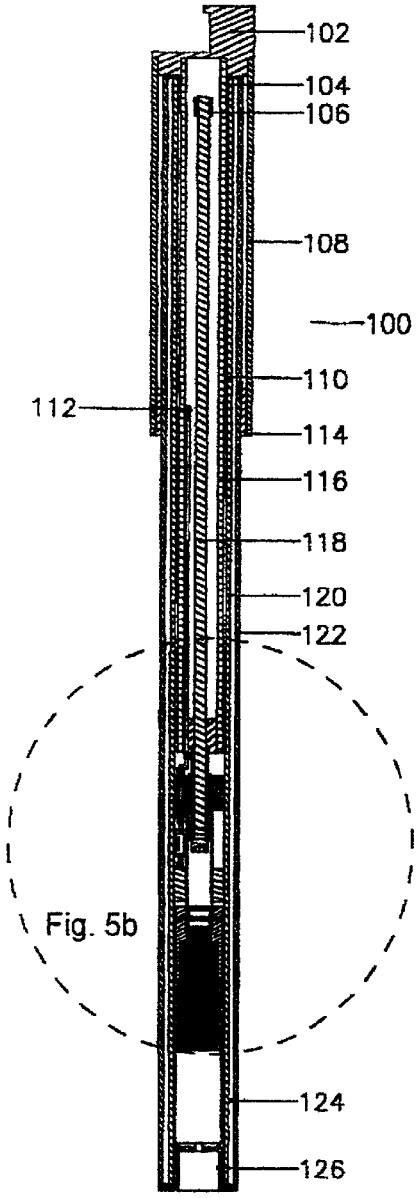
FIG. 5*a* is a linear actuator (full half sectional view showing internal part detail)
Figure 5B:
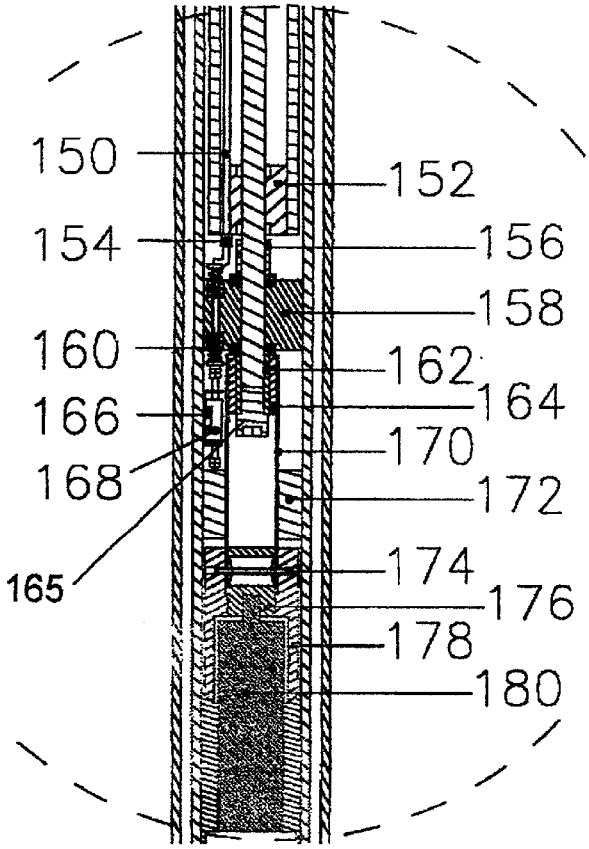
FIG. 5*b* is a linear actuator (cut away full sectional view showing more detail in the motor-drive screw area)

Details of the actuator 100 may be seen by referring to FIG. 5*a*. For greater detail, refer to the cutaway view of the central section of the actuator, FIG. 5*b*. The actuator crown 102 seats inside the top of the dust shield 108 and is pinned in place. The dust seal bearing 114 snaps in place in the bottom of the dust shield 108 with 3 interlocking rings set into matching grooves on the inside of the dust shield 108. The linear ram 116 fits into a square socket on the bottom of the actuator crown 102 and is held in place by the same pins that hold the actuator crown 102 to the dust shield 108. The dust seal bearing 114 slip fits over the outer diameter of the main body extrusion allowing movement up and down without allowing exterior particle contaminants to enter past the seal. The spines 120 fit into a channel inside the main body extrusion 122. The motor mount 126 holds the motor 180 and the electronics control board (not shown) in the bottom of the main body extrusion 122. Appropriate slots in the surface of the motor mount 126 allow the placement of the spines 120 between the exterior of the motor mount 126 and the interior of the main body extrusion 122. The drive coupler 176 is attached by threads and a counter screw to the drive end of the motor 180. The drive coupler 176 slip fits into the bottom of the drive shaft 170 and is held in place by the roll pin 174. The anti-rotate lock cap 178 press fits around the bottom end of the drive shaft 170 and is secured in place by the same roll pin 174 that allows the drive coupler 176 to turn the drive shaft 170. The spring loaded drive socket 164 is press fit into the top end of the drive shaft 170. The geometry of the drive coupler 176 creates a linear movement in the drive shaft 170 and communicates with the anti-rotate lock cap 178 just before rotation begins. Lock teeth geometry at the interface of the anti-rotate lock cap 178 and the motor mount 126 prevent rotation of the mechanism when the motor 180 is not active and turning in either direction. This action defines the actuator's mechanical braking function. Four bolts hold the bottom of the spines 120 and the motor mount 126 to the main body extrusion 122.

The drive shaft bearing spacer 172 is seated in the spines 120 and centers the drive shaft 170. The drive nut 162 is screwed halfway onto the bottom end of the all-thread 118. The lock bolt 165 is screwed into the bottom portion of the drive nut 162 against the face of the all-thread 118, this locks the drive nut 162 and all-thread 118 together. The bearing block with thrust bearings 158 is located on the all-thread 118 between the drive nut 162 and the bearing position lock nuts 156. The linear ram nut 152 is positioned an appropriate distance away from the top of the bearing position lock nuts 156 on the all-thread 118. The linear ram nut 152 is pinned to the inside bottom of the linear ram 116. The two ram bearing guides 110 are appropriately positioned to prevent the linear ram 116 from flexing out of alignment or rotating in its housing during operation. The all-thread end lock nuts 106 are screwed onto the top end of the all-thread 118.

The limit switch rod position lock nuts 154 are placed on the limit switch rod 150 at the top and at the bottom so that when the linear ram nut 152 moves and contacts one of the limit switch rod position lock nuts 154, it moves the limit switch rod 150 up or down accordingly. The limit switch rod 150 then moves the limit switch trigger block 168 up or down accordingly. The limit switch trigger block 168 then activates the limit switch 166 sending a signal to the field box(es) that the actuator (P-L actuator 14 or CH actuator 16) are at the end of their designed travel limit. A reversing relay immediately switches polarity to the drive motor. That relay is actuated by the limit switch. A capacitor is then positioned across the reversing relay coil. This capacitor provides a specific amount of time for the motor to reverse thus giving the trigger block sufficient time to clear the limit switch and eliminate bounce-back. Simultaneously, when the reversing switch is actuated, it closes a set of contacts that alerts the computer that the end of travel has been reached.

In an alternative embodiment of this invention to allow a cost effective solution to the problem of sweeping one or a plurality of antennas from one sector to another sector of the same cell site array, and then compliment the new P-L and CH settings of their new sector. This cost effective solution allows the system to balance sector traffic loads and access underutilized capacity in sectors that have capacity to spare.

Field Connection Interface

Figure 6:
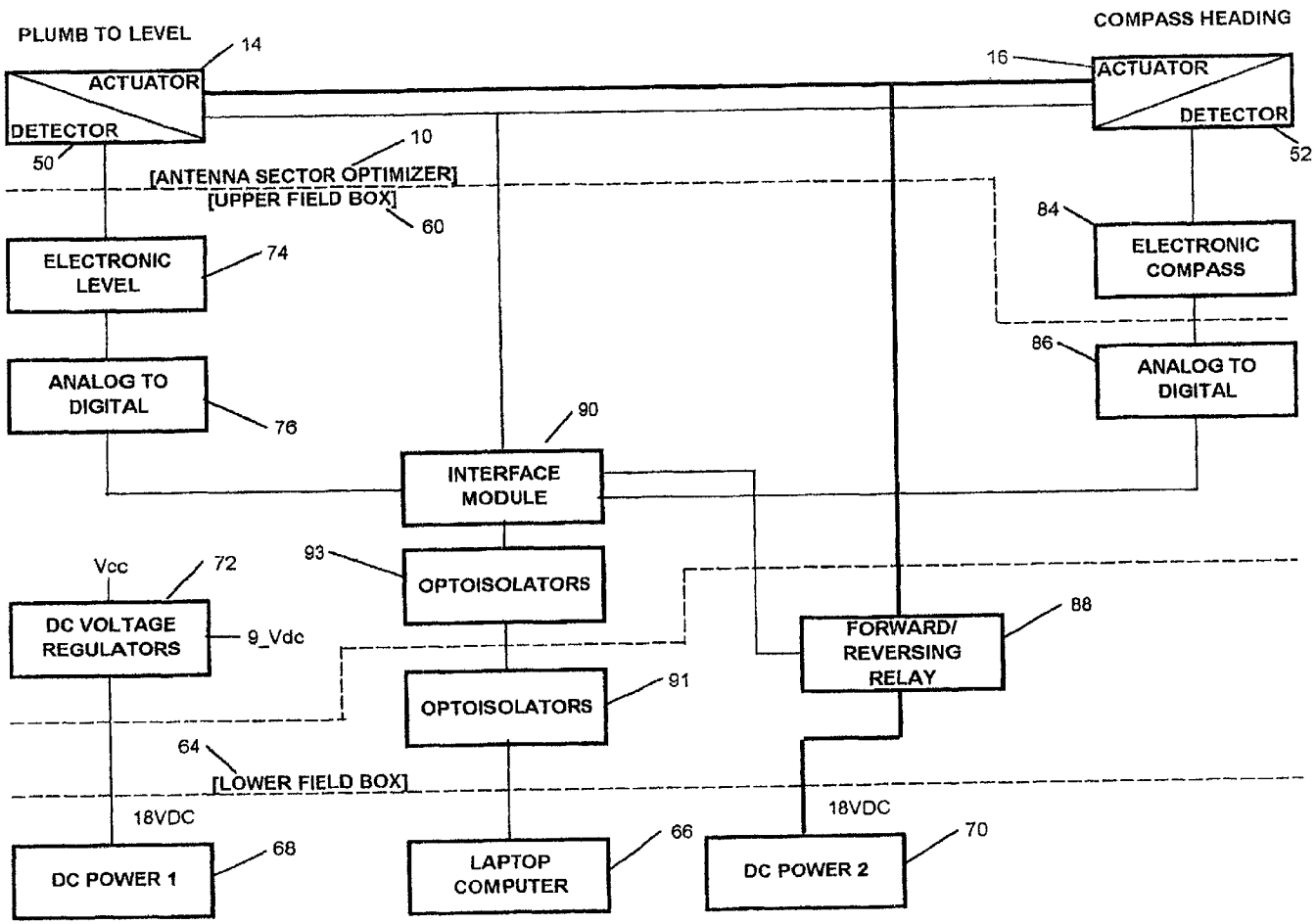
FIG. 6 is a system block diagram

FIG. 6 is a signal block diagram for the system for remotely adjusting the P-L and CH of one or a plurality of communication antennas showing the antenna sector optimizer, the field box(es), the laptop computer, and the DC power sources.

Referring to FIG. 6, the P-L portion comprises a P-L actuator 14 and a P-L detector 50. The CH portion comprises a CH actuator 16 and a CH detector 52. Both actuators, in the preferred embodiment, are powered by standard DC motors. When DC power is applied with a positive polarity to the actuator, the actuator increases in length. When DC power is applied with a negative polarity to the actuator, the actuator decreases in length. When the motors are not being actuated, a shorting resistor is placed across the terminals of the motor thereby creating a method for dynamic braking.

There is one P-L detector 50 and one P-L actuator 14 for each antenna in the sector. A sector typically has from one to four antennas. The P-L detector 50 detects the antenna P-L with respect to true vertical or horizontal. Unlike sensors that measure antenna angle with respect to a tower member, this novel invention automatically eliminates errors caused by unavoidable changes in the base reference by using a P-L detector that incorporates an encapsulated electrolyte solution. In the preferred embodiment, this is a dual axis DX-045 detector sold by AOSI of Linden, N.J.

Each antenna sector has a CH actuator 16 to adjust the CH or direction of the entire antenna sector. Each sector also has a CH detector 52 for determining the actual CH of the sector. There is one CH actuator 16 and one CH detector 52 for each sector. A tower or site, may have multiple sectors. In the preferred embodiment, the CH detector used is a model TCM2-20 sold by PNI Corporation of Santa Rosa, Calif.

So that each antenna and each sector may be adjusted independently, each actuator (both P-L actuators and CH actuators) has a separate activation relay for the detector and separate activation relay for the actuator motor. This allows all antennas to be independently monitored and adjusted using one set of field boxes and one laptop computer by simply addressing each antenna P-L or each sector CH. An activation relay for the P-L actuator 14 is housed in the P-L actuator 14. An activation relay for the CH actuator 16 is housed in the CH actuator 16. An activation relay for the P-L detector 50 is housed inside the P-L actuator 14. An activation relay for the CH detector 52 is housed inside the upper field box 60. In the preferred embodiment, wires from the P-L detectors 50 are connected to their respective actuators. Wires from the CH detectors 52 are connected to the upper field box 60. Wires from all actuators are connected to the upper field box 60.

The field box 60 contains electronic circuitry to provide the signal conditioning and the logic selection for the specific antenna and/or sector being addressed. The P-L detector 50 is connected to the electronic P-L circuit board 74 wherein the amount of deviation from true P-L (that is, with respect to the earth's gravity) is converted into a 0–5VDC signal. This signal, in turn, is converted to an 8 bit digital signal by the analog to digital converter 76 that is compatible with the laptop computer 66.

The CH detector 52 is connected to the electronic compass circuit board 84 wherein the amount of deviation from true North (that is, with respect to the earth's magnetic field) is converted into a 0–5VDC signal. This signal, in turn, is converted to an 8 bit digital signal by the analog to digital converter 86, which is compatible with the laptop computer 66.

Figure 6A:
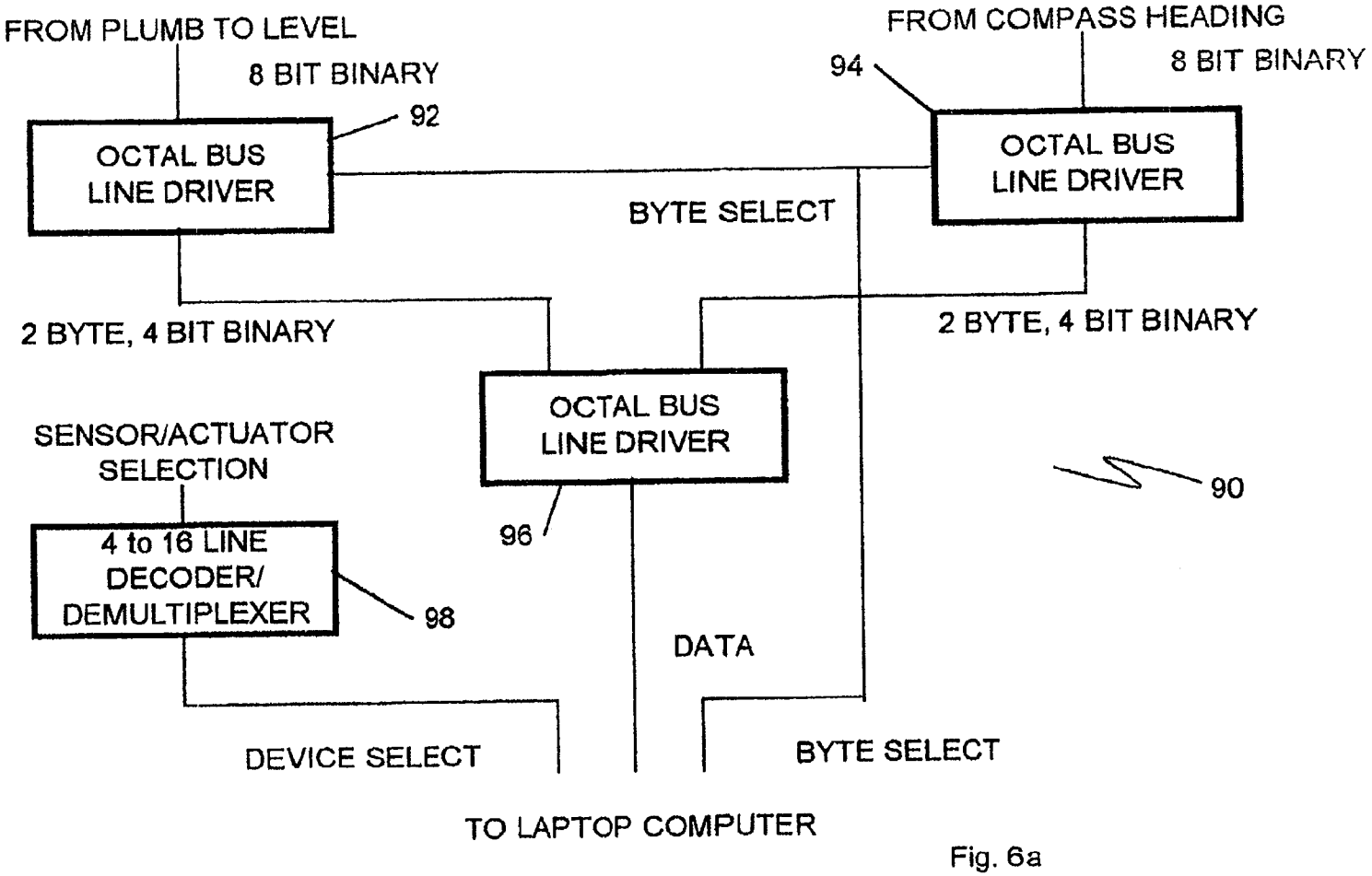
FIG. 6*a* is a system block diagram, showing details of the interface module

In FIG. 6*a*, the interface module 90 relays the logical addressing and data reading function in response to commands given by the laptop computer 66. Eight bit binary data from each detector is converted into two, 4 bit binary bytes by each of two octal bus line drivers 92 and 94. The byte is selected by the laptop computer. Further, a third octal bus line driver 96 selects which of the two data sources the laptop computer is reading at any one time. Here, the laptop computer selects which detector is being read. This conversion allows the data from the two detectors to be transferred to the laptop computer over four wires, rather than the sixteen wires that would normally be required. Also, by addressing each antenna and each sector separately, the number of sets of wires needed to read all the data is substantially reduced from a maximum of 19 sets to just the 1 set. The 4 to 16 Line Decoder/Demultiplexer 98 selects the detector relay and the actuator relay that is requested by the laptop computer. This is not meant to be a limitation, but rather it is within the scope of contemplation of this invention that the 4 to 16 Line Decoder/Demultiplexer 98 could be potentially expanded to include additional such devices. Referring again to FIG. 6, to insulate the electronic circuits in the field boxes to transients and other electrical disturbances that may cause damage or malfunction, each box is provided with optical isolation circuits for each communication line. In the preferred embodiment, there are two boxes requiring two optoisolators 91 and 93.

In the preferred embodiment, there are two identical sources of power, 68 and 70, both of which are standard rechargeable 18 VDC battery packs. DC power 168 is connected to a voltage regulator circuit 72 thereby creating regulated voltages Vcc and 9_Vdc. These regulated voltages are needed to power the logic contained in the field boxes 60 and 64, and the electronic compass 84 as part of the antenna sector optimizer 10, and the electronic P-L board 74.

In response to a command from the laptop computer, a forward/reversing relay 88 reverses the polarity of the 18VDC power circuit used to drive the P-L actuator 14 and the CH actuator 16 when it is desired to increase or decrease the length of either actuator.

In the preferred embodiment, power, control and computing functions are brought to and applied to the system by the technician while making adjustments. This is to prevent tampering or sporadic responses to outside disturbances, as would be possible in a system with on site power and control capability. Also, another benefit of portable power and user furnished computing equipment, allows the same equipment to be used on many antenna sites, thereby providing an additional cost effective solution to the optimization process.

Laptop Computer and Application Software

The key to the performance of this system for remotely adjusting the P-L and CH of one or a plurality of communication antennas is in the antenna optimization application software. In the preferred embodiment, the antenna optimization application software is run on a laptop computer. The computer having the antenna optimization application software allows the operator to remotely adjust the P-L of any antenna or the CH of any antenna sector merely by connecting the laptop computer to the optimizer system at the lower field box This eliminates the need for the technician to climb the antenna tower. By connecting the DC power source along with the laptop computer, the technician may perform the necessary optimization adjustments without the need for any other additional outside resources.

The system for remotely adjusting the P-L and CH of one or a plurality of communication antennas is not limited to use by a locally connected laptop computer. An alternative embodiment might utilize an on site desktop computer. Another alternative embodiment might utilize a mainframe computer. It is contemplated that computers located at other sites, connected by wire or modem, may also be used.

The antenna optimization application software can run on almost any personal computer (PC) with minimal specifications. The PC may be any one of the standard microprocessor types commonly found in use. Since large amounts of processing power is not necessary, any suitable 8 bit or greater microprocessor, such as for example an Intel 86286 or greater, with a processing speed of 20 MHz. or greater, may be used. The PC should have at least one standard parallel port, and a standard display. It need not have sound reproduction capability.

The application software for remotely adjusting the P-L and CH of one or a plurality of communication antennas operates under any version of MS Windows or other standard operating system that employs a similar architecture.

Figure 7A:
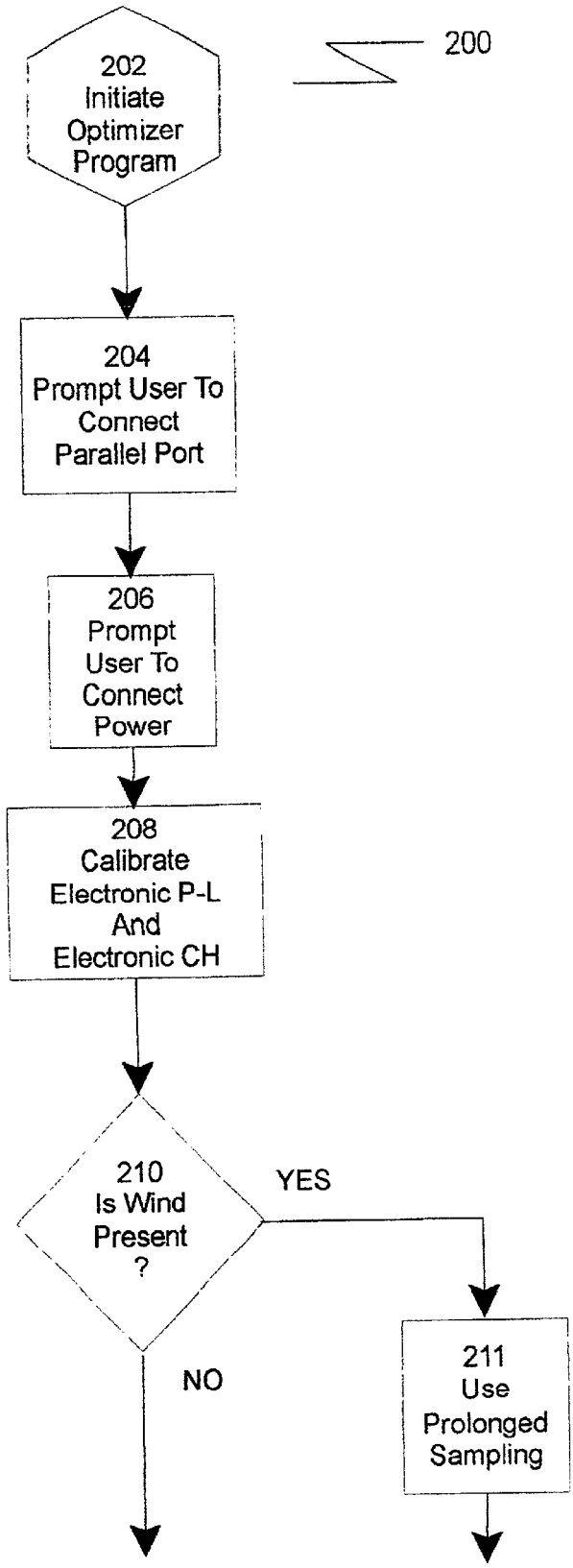
FIG. 7 is a software block diagram
Figure 7B:
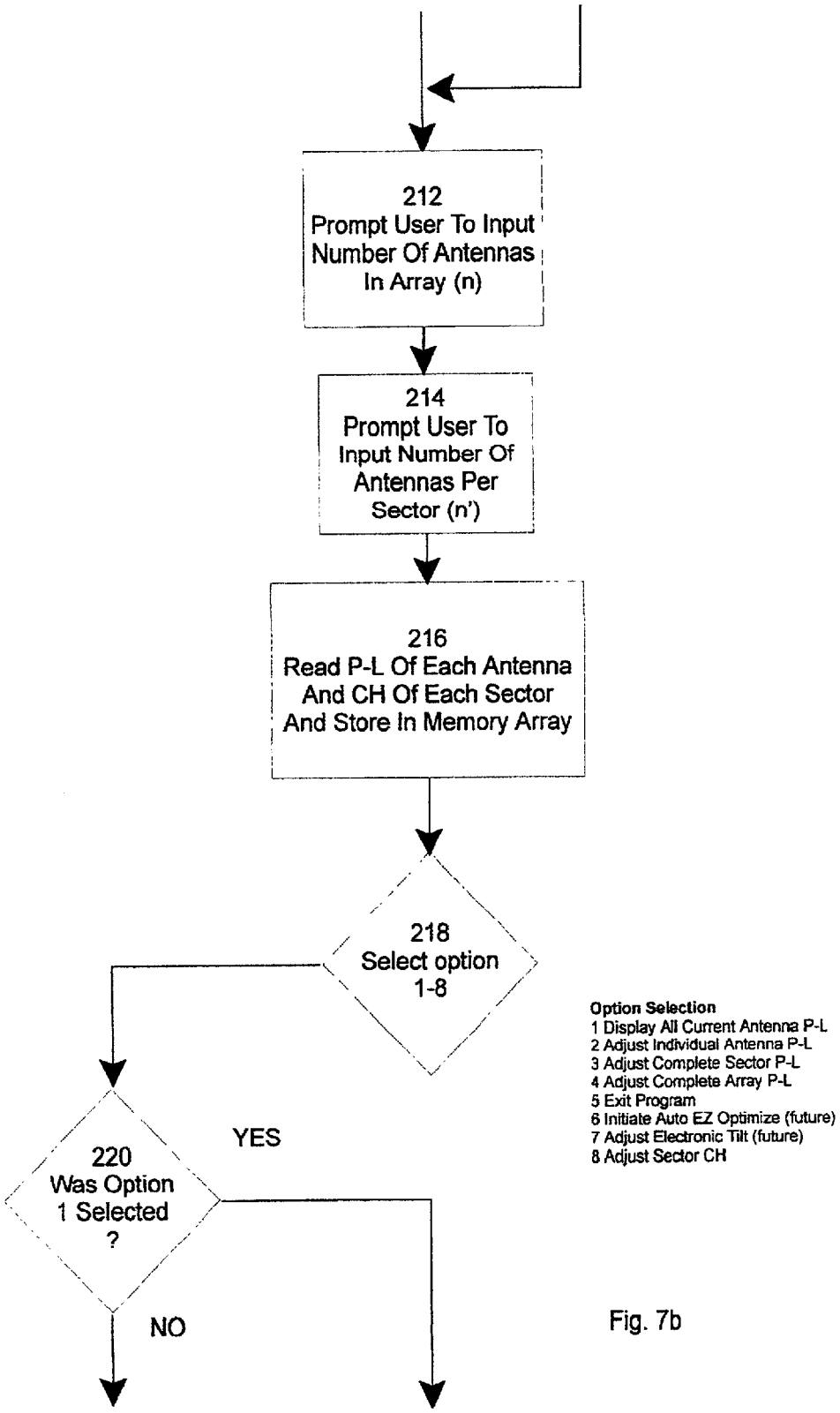
Figure 7C:
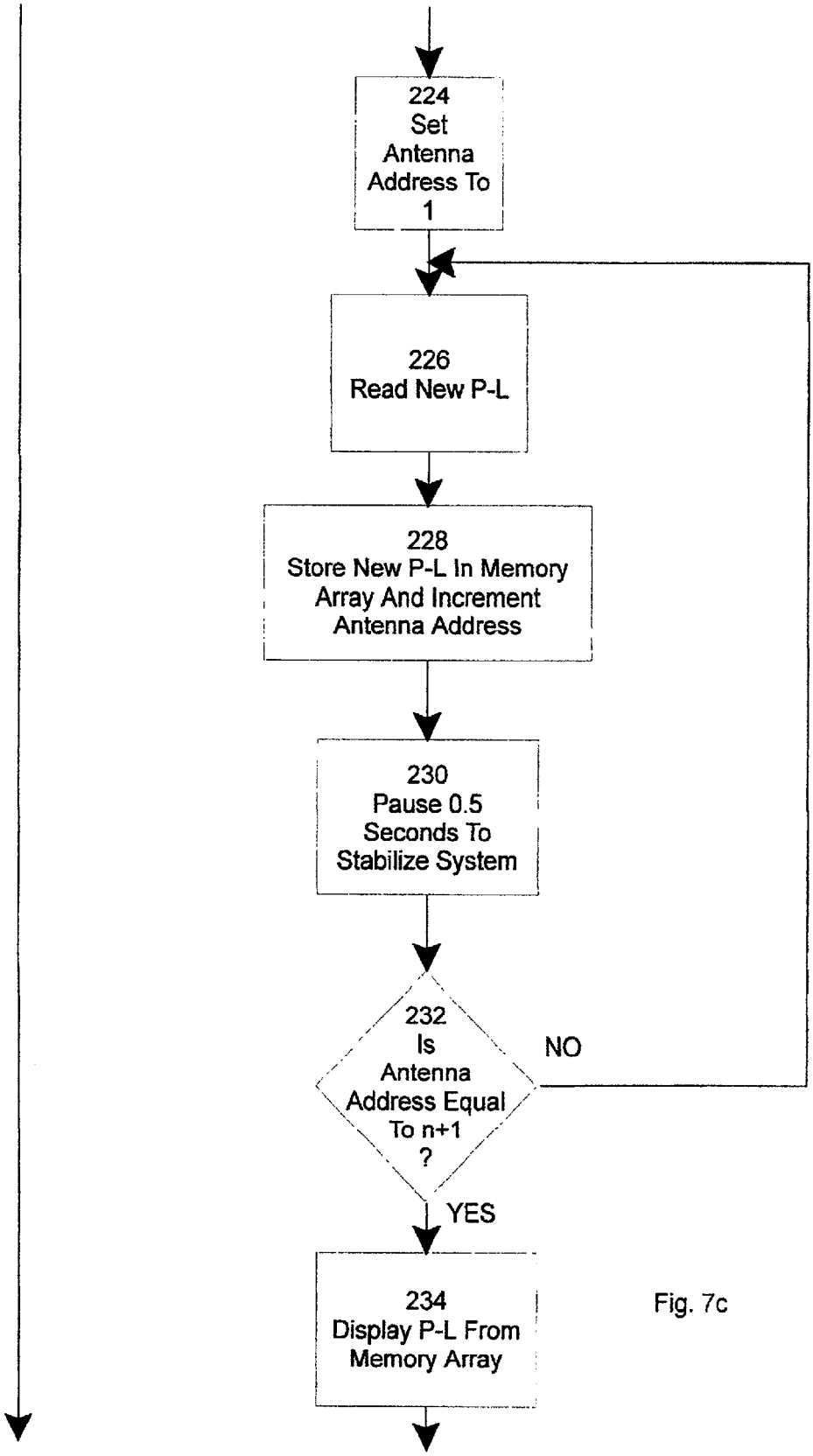
Figure 7D:
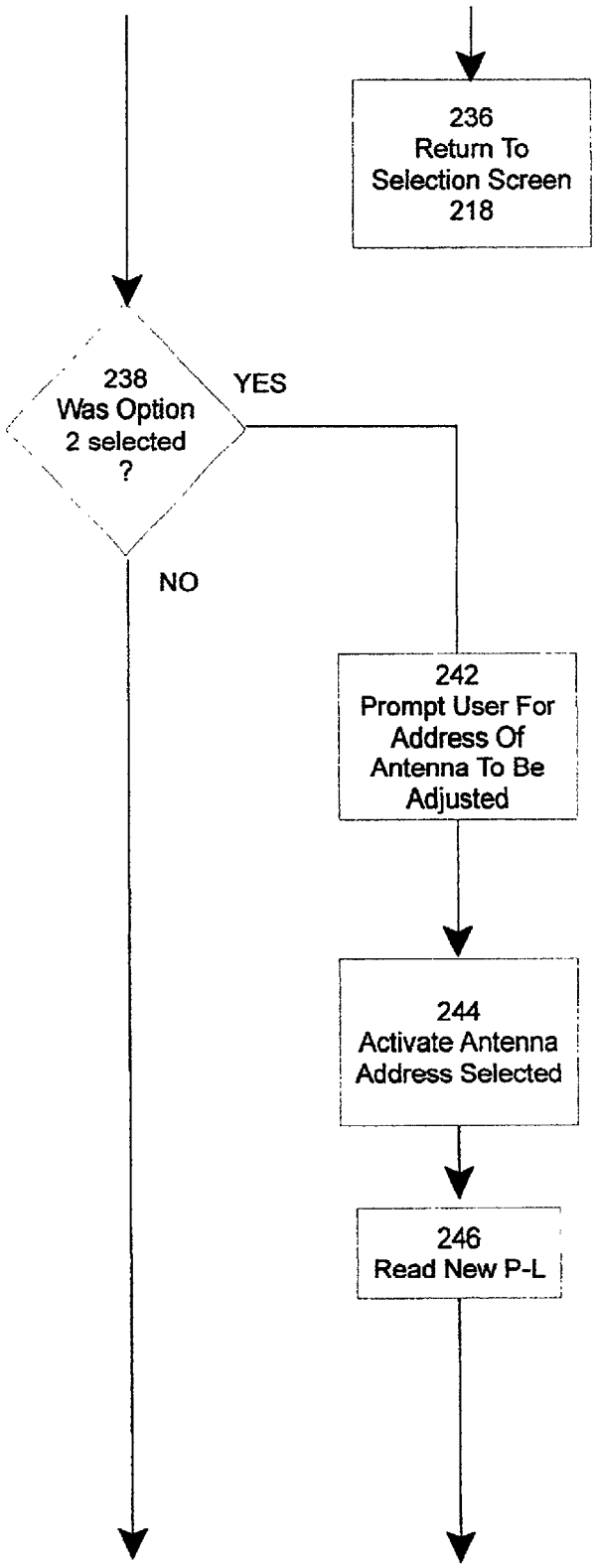
Figure 7E:
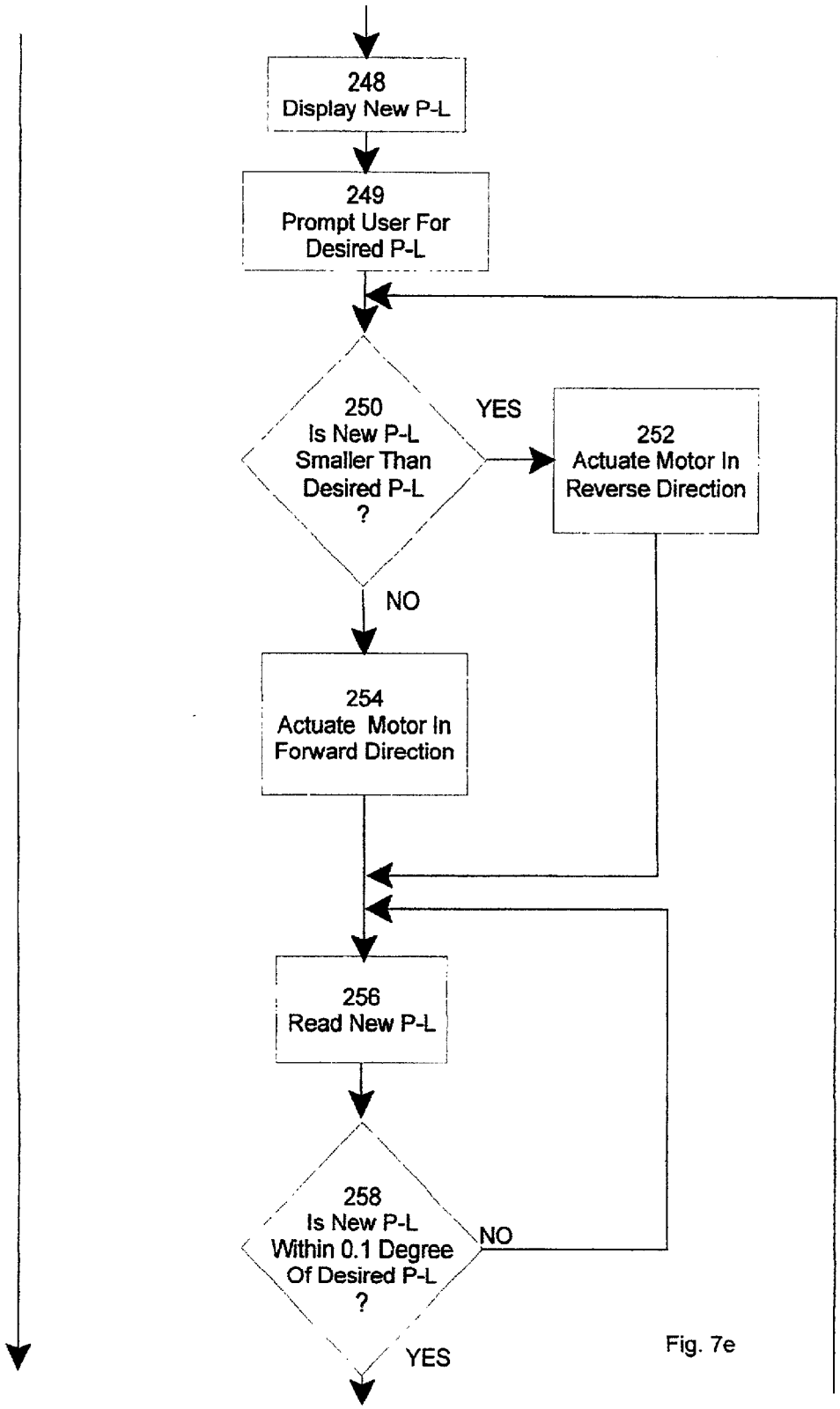
Figure 7F:
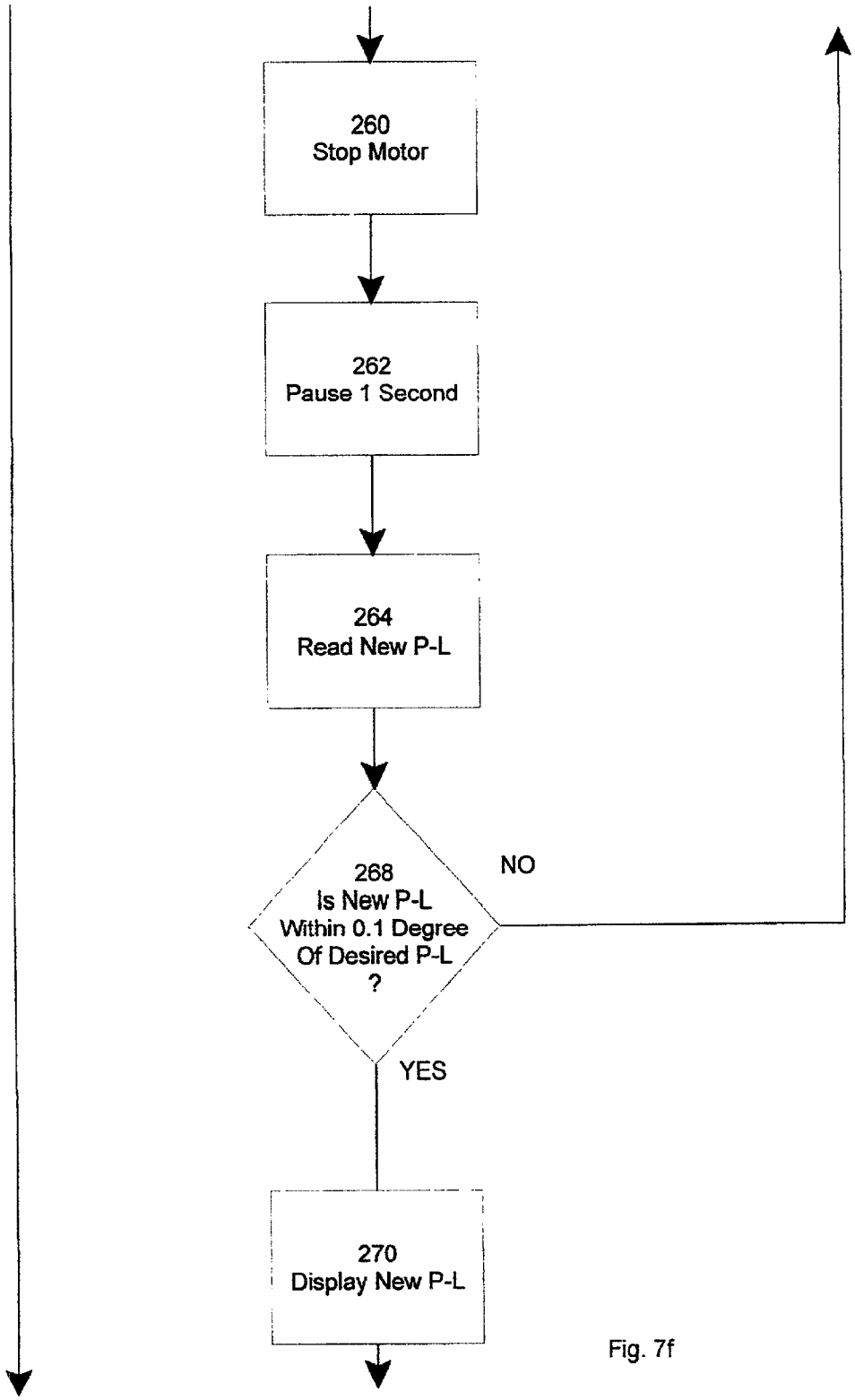
Figure 7G:
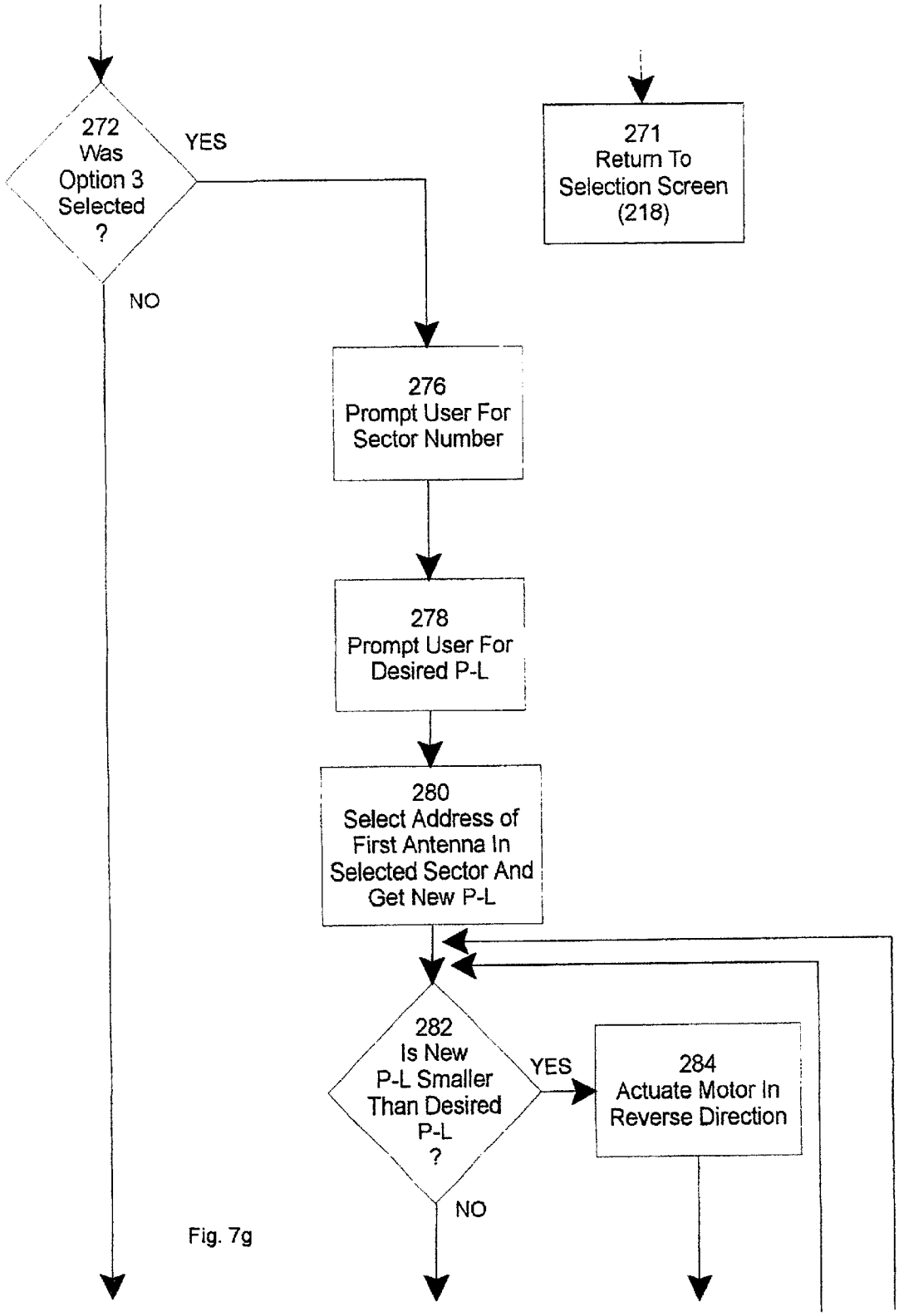
Figure 7H:
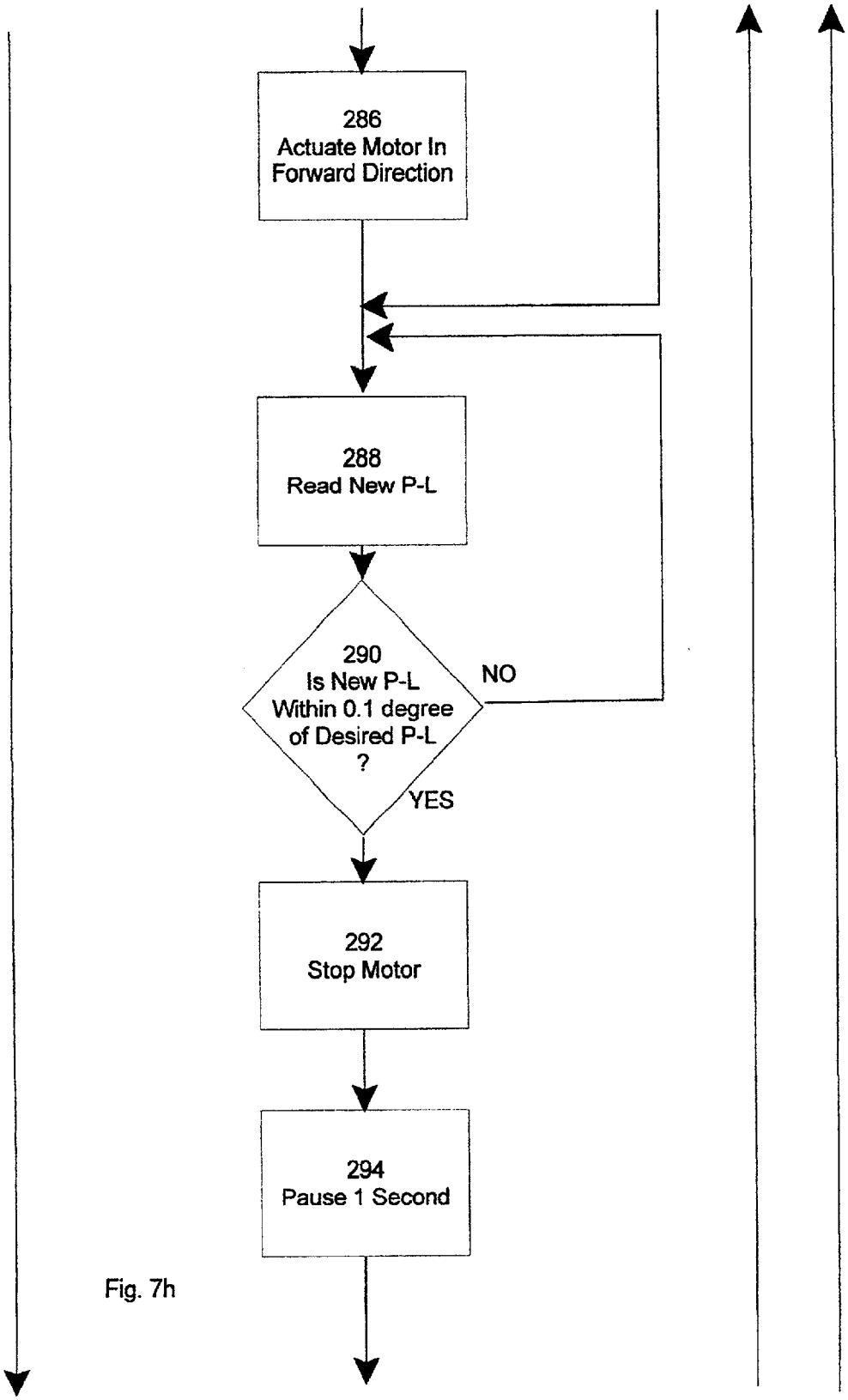
Figure 7I:
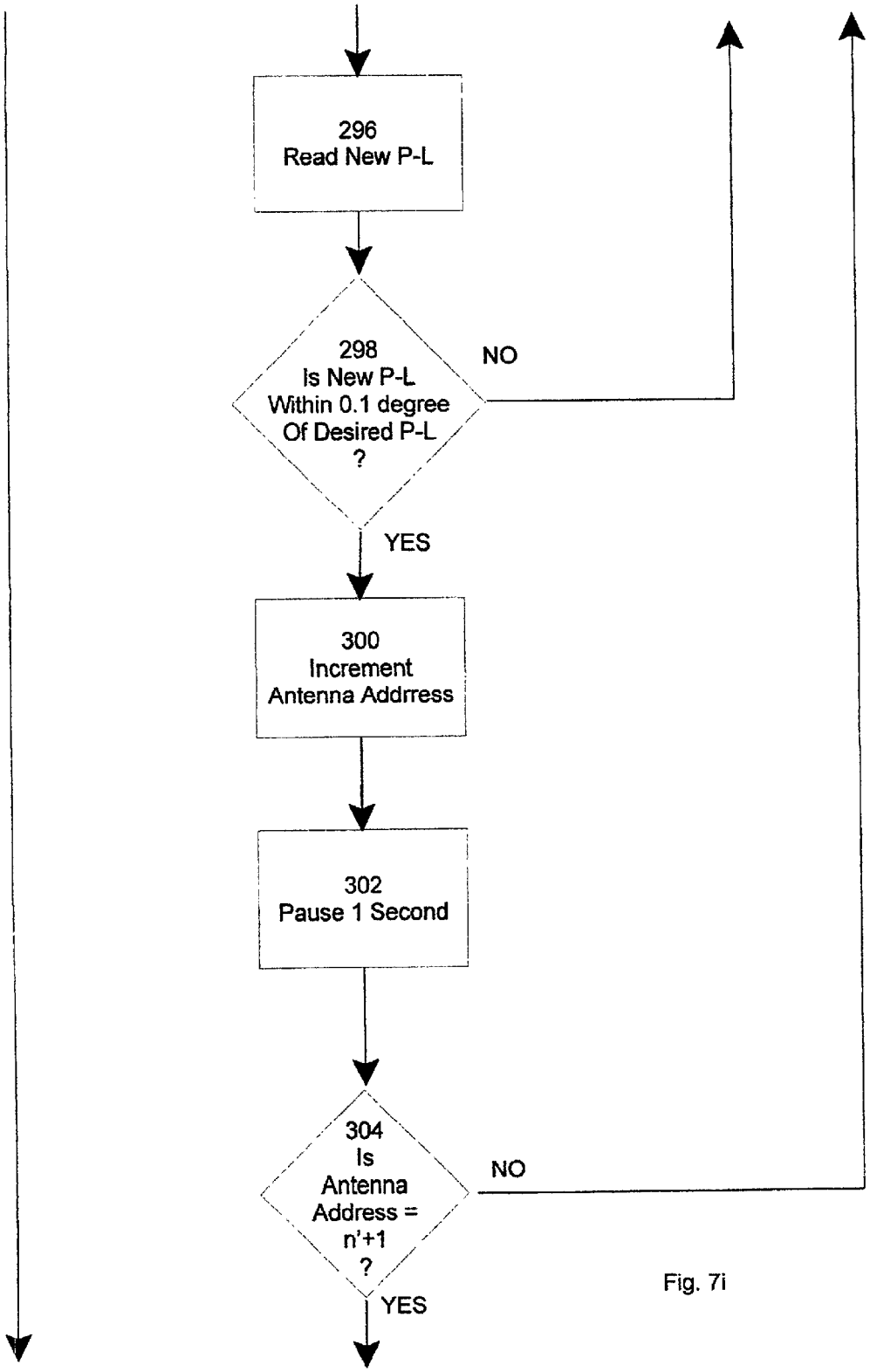
Figure 7J:
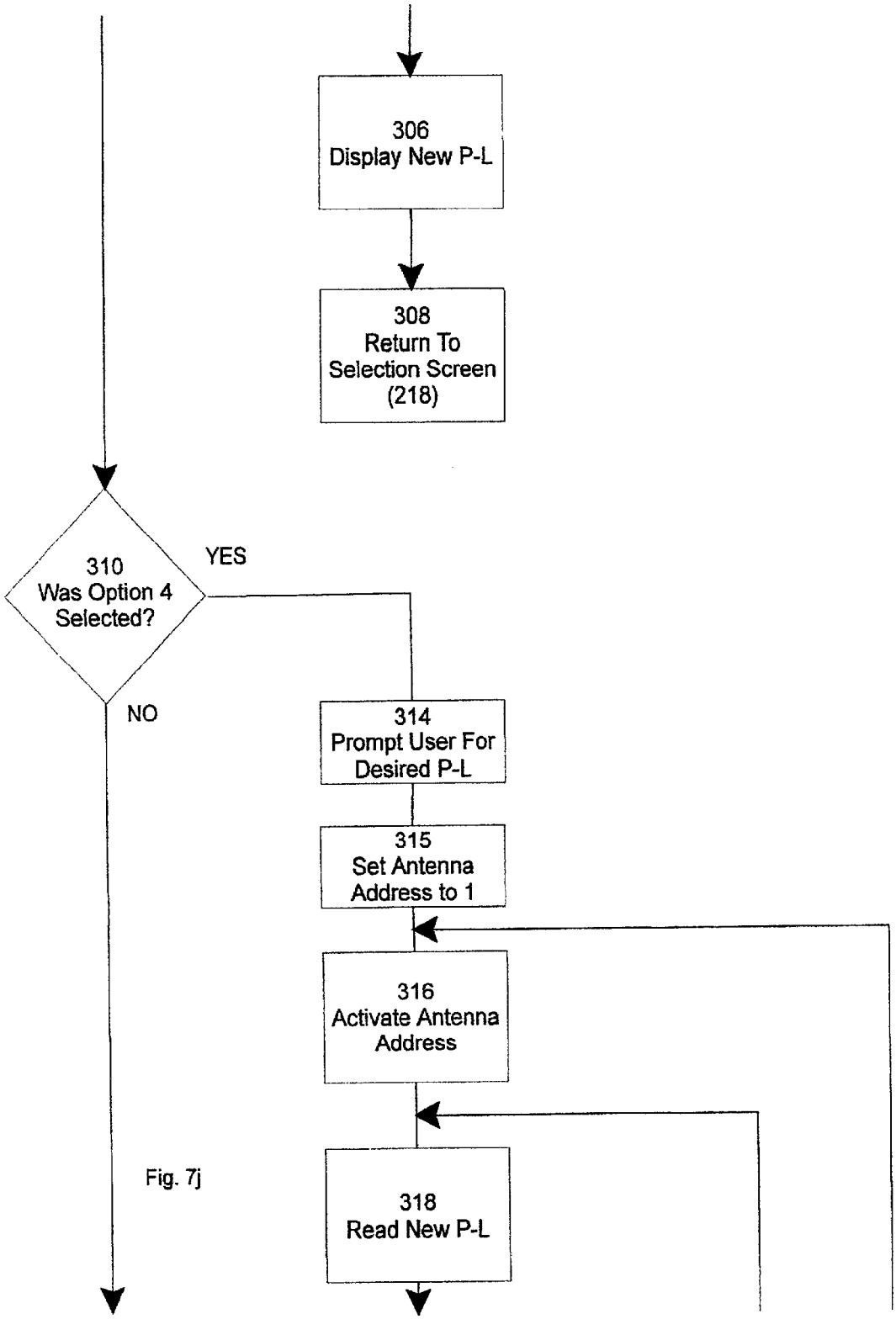
Figure 7K:
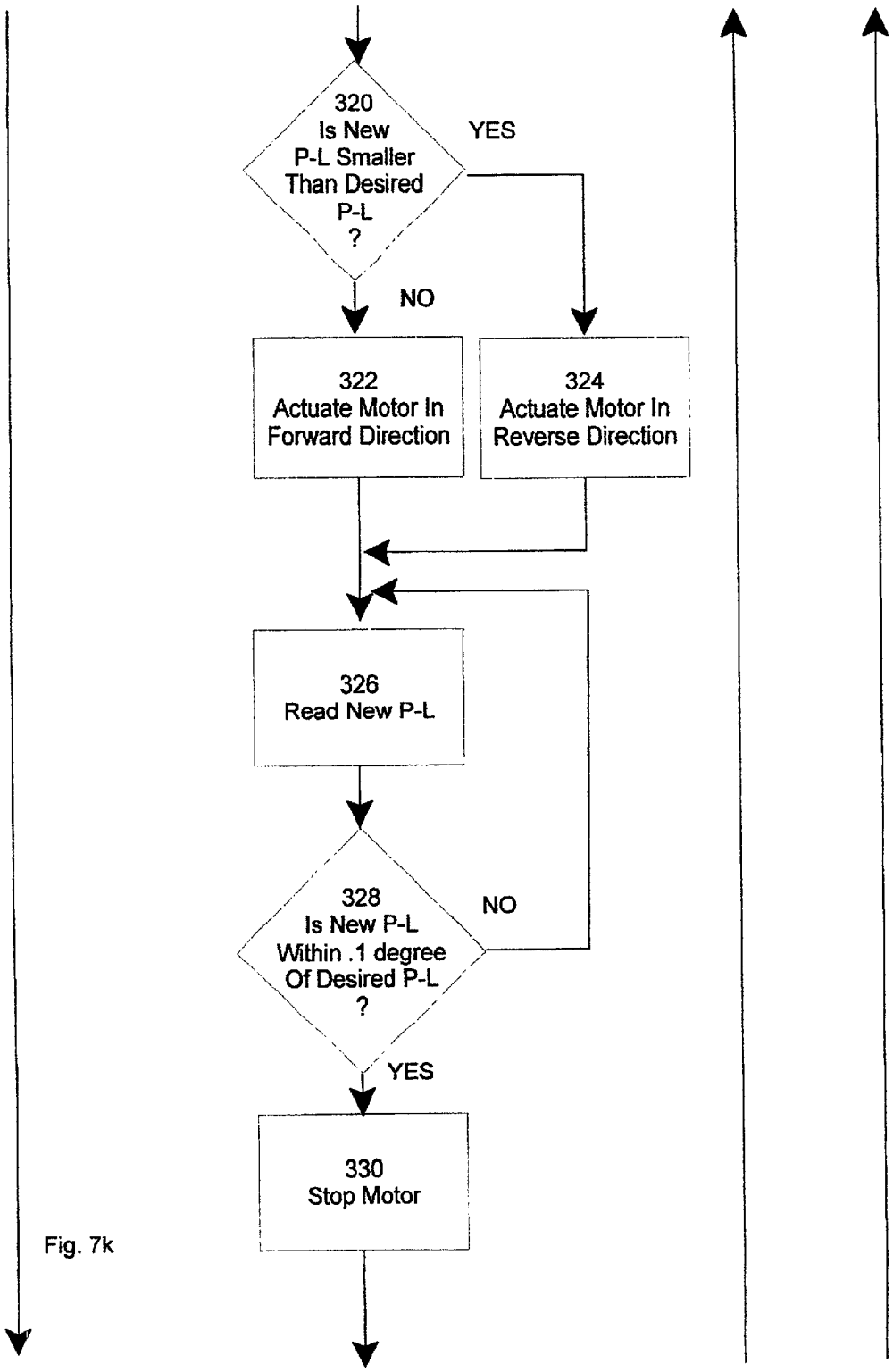
Figure 7I:
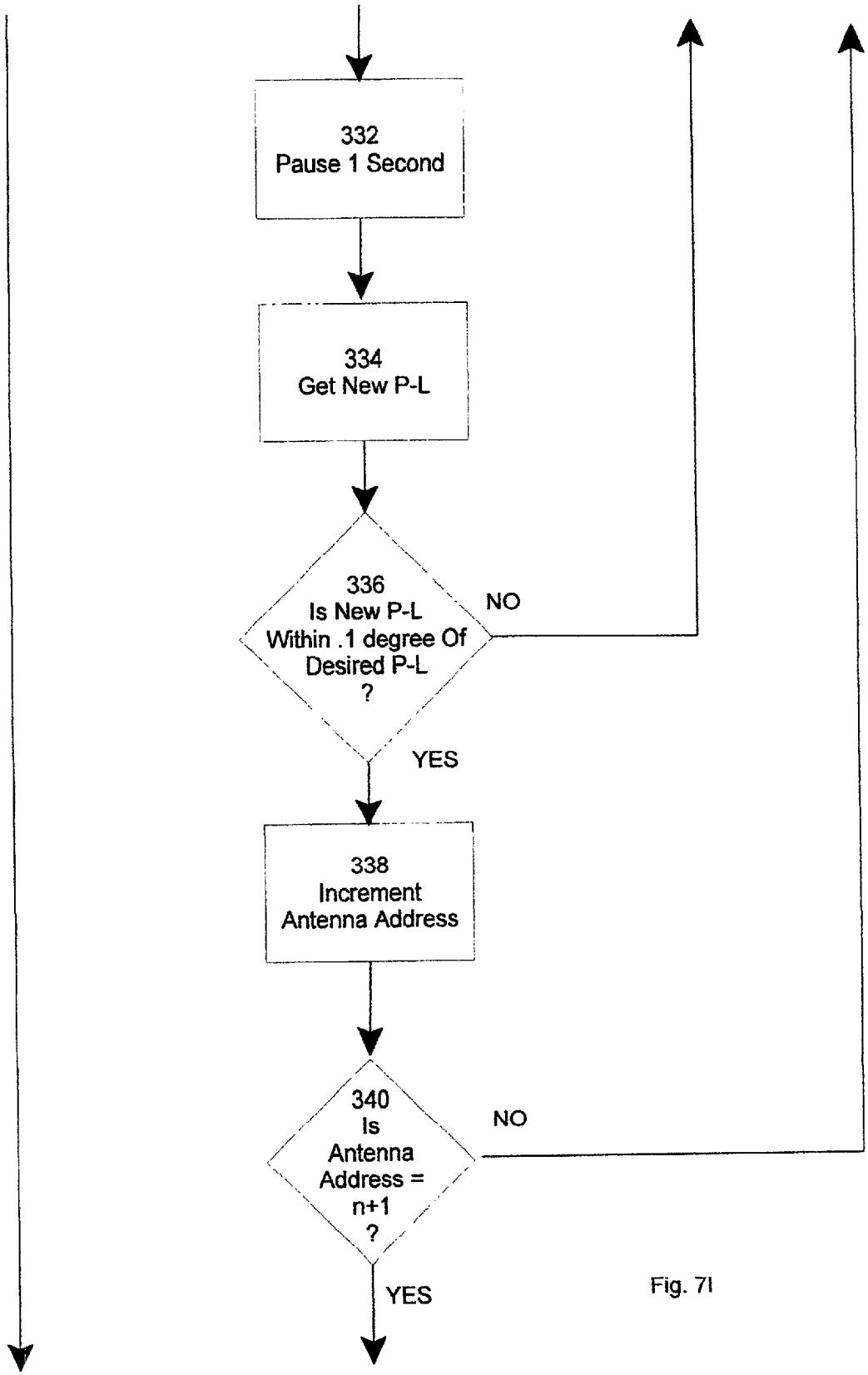
Figure 7M:
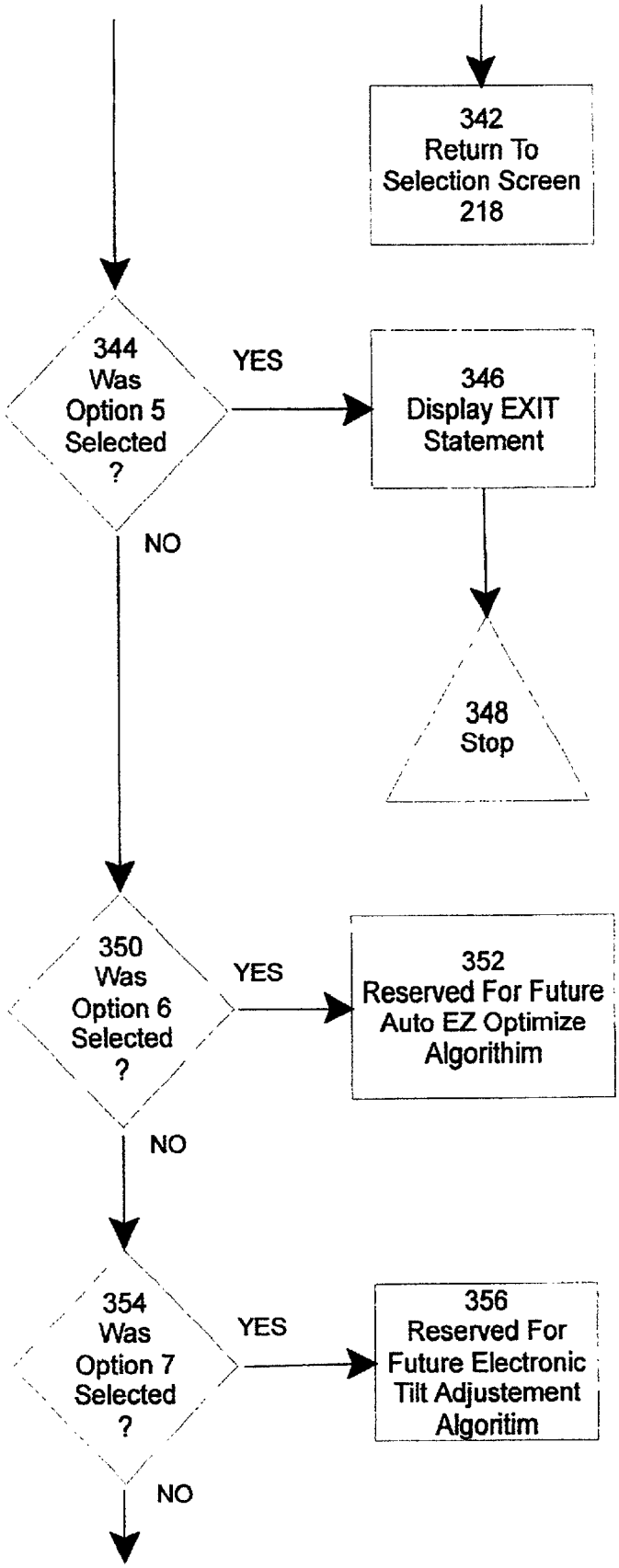
Figure 7N:
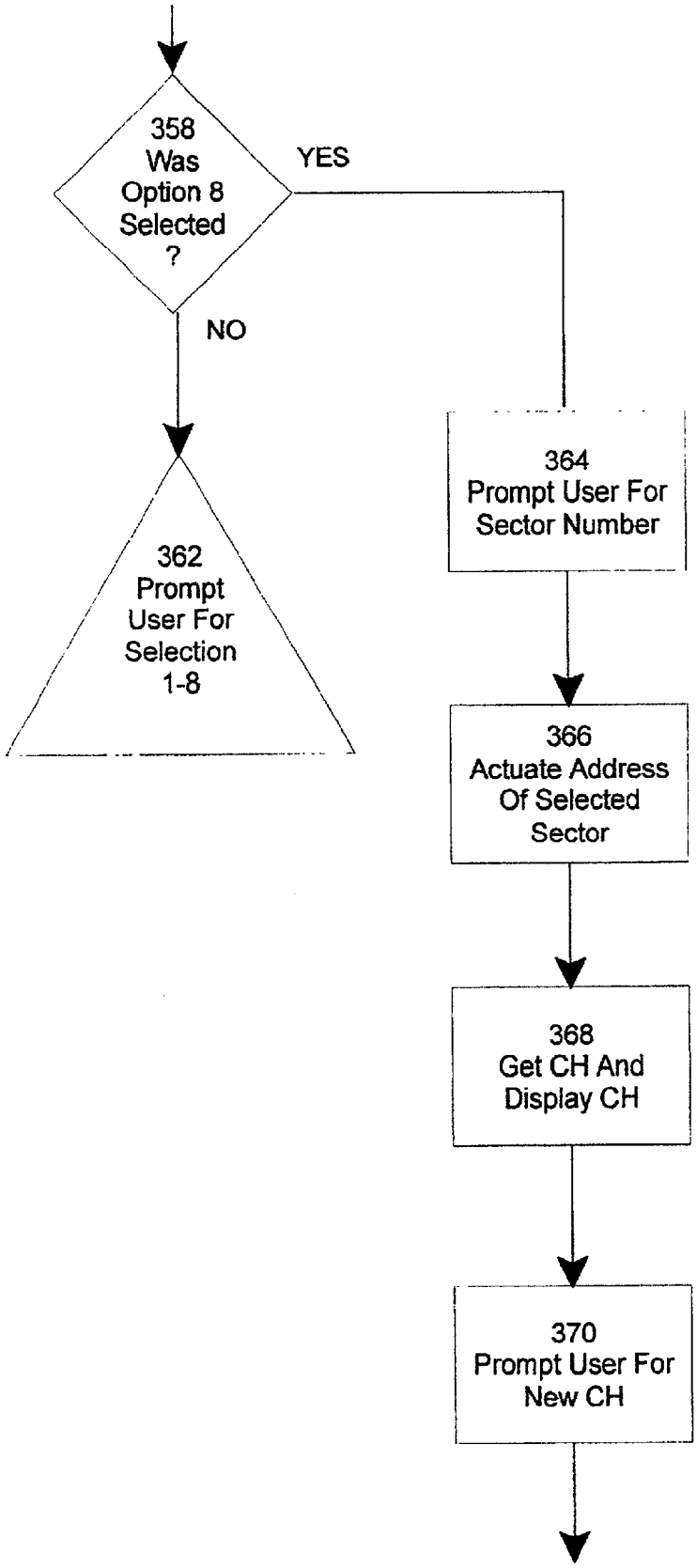
Figure 7O:
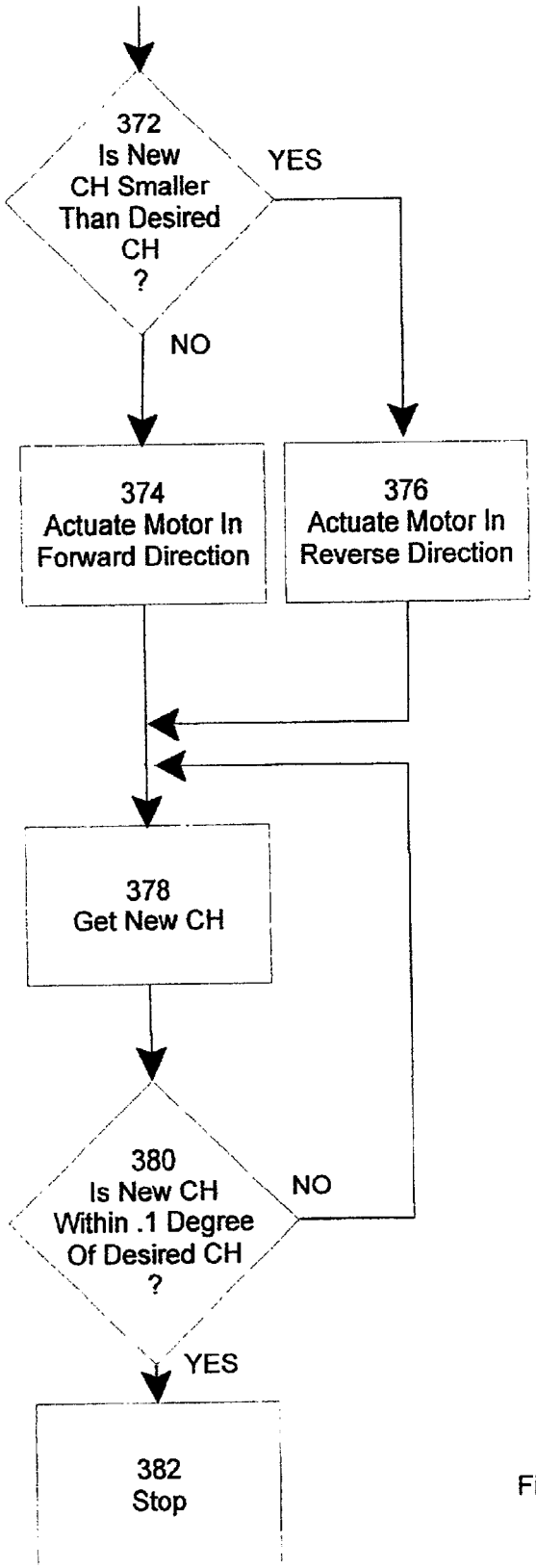

A block diagram of the application software is provided in FIG. 7*a* through FIG. 7*o*. The application software 200 comprises an initialization routine 202, followed by two operator prompts, connect to parallel port 204 and connect power source 206, and a routine calibrating the electronic P-L and CH 208. If wind is present 210, the program branches to prolonged sampling 211. If not, the program maintains its normal sampling and advances directly to the additional prompts. The program prompts the user to input the number of antennas in the array 212 (n), and input the number of antennas per sector 214 (n'). Then the program reads the P-L value from each antenna and the CH value from each sector, and stores the values in a memory array 216.

The user is asked to select one of eight options 218. If option 1 (Display All Current Antenna P-L) was selected 220, the program branches to the option 1 routine. Option 1 proceeds to set the antenna address to 1 224, read a new P-L value from the selected antenna 226, store it in the memory array and increment the antenna number 228, and pause 0.5 seconds to stabilize the system 230. If the antenna number is n+1 232, all the P-L values from the array are displayed 234, followed by a return to the selection screen 236. If the antenna number is not n+1 232, then the program returns to read a new P-L value 226.

If the one of eight options 218 chosen was not option 1, then the program will test to see if option 2 was selected 238. If option 2 (Adjust Individual Antenna P-L) was selected, then the program branches to the option 2 routine. Option 2 proceeds to initiate the antenna adjustment routine where the user is prompted for the antenna address to be adjusted 242, actuates the address of the selected antenna 244, read a new P-L value 246, displays the new P-L value, prompts the user for a desired P-L value 248, and determines if the new P-L value is smaller than the desired P-L value 250. If the new P-L value is smaller, the program branches to actuate the P-L actuator motor in a reverse direction 252 before proceeding to the next operation. Or, if the new P-L value is not smaller, the program continues to actuate the P-L actuator motor in a forward direction 254. The program reads a new P-L value 256 and checks to see if the new P-L value is within 0.1 degree of the desired P-L value 258. If the answer is no, the program returns to get another new P-L value 256. If the answer is yes, the program stops the P-L actuator motor 260, pauses 1 second 262, and gets a new P-L value 264. If the new P-L value is not within 0.1 degree of the desired P-L value, the program returns to check if the new P-L value is smaller than the desired P-L value 250. If the new P-L value is within 0.1 degree of the desired P-L value, the program continues and displays the new P-L value 270 and returns to the selection screen 271.

If the one of eight options 218 chosen was neither option 1 nor option 2, then the program will test to see if option 3 was selected 272. If option 3 (Adjust Complete Sector P-L) was selected, then the program branches to the option 3 routine. Option 3 proceeds to prompt the user for the sector number 276, prompt the user for a desired P-L value 278, selects the address of the first antenna in the sector and gets the new P-L value 280. The program tests to see if the new P-L value is smaller than the desired P-L value 282. If the new P-L value is smaller than the desired P-L value, the program branches to actuate the P-L actuator motor in a reverse direction 284 before proceeding to the next operation. Or, if the new P-L value is not smaller than the desired P-L value, the program continues to actuate the P-L actuator motor in a forward direction 286. The program reads a new P-L value 288 and checks to see if the new P-L value is within 0.1 degree of the desired P-L value 290. If the answer is no, the program returns to get another new P-L value 288. If the answer is yes, the program stops the P-L actuator motor 292, pauses 1 second 294, and reads a new P-L value 296. If the new P-L value is not within 0.1 degree of the desired P-L value, the program returns to check if the new P-L value is smaller than the desired P-L value 282. If the new P-L value is within 0.1 degree 298, the program increments the antenna address 300 and pauses for one second 302. If the antenna number is not n'+1 304, the program returns to check if the new P-L value is smaller than the desired P-L value 282. If the antenna number is n'+1, the program continues and displays the new P-L value 306 and returns to the selection screen 308.

If the one of eight options 218 chosen was not any of the options 1 through 3, then the program will test to see if option 4 was selected 310. If option 4 (Adjust Complete Array P-L) was selected, then the program branches to the option 4 routine. Option 4 proceeds to prompt the user for a desired P-L value 314, set the antenna address to 1 315, activate the antenna address for the first antenna 316, and get a new P-L value 318. The program tests to see if the new P-L value is smaller than the desired P-L value 320. If the new P-L value is smaller than the desired P-L value, the program branches to actuate the P-L actuator motor in a reverse direction 324 before proceeding to the next operation. Or, if the new P-L value is not smaller than the desired P-L value, the program continues to actuate the P-L actuator motor in a forward direction 322. The program reads a new P-L value 326 and checks to see if the new P-L value is within 0.1 degree of the desired P-L value 328. If the answer is no, the program returns to get another new P-L value 326. If the answer is yes, the program stops the P-L actuator motor 330, pauses 1 second 332, and reads a new P-L value 334. The program then checks to see if the new P-L value is within 0.1 degree of the desired P-L value 336. If the new P-L value is not within 0.1 degree of the desired P-L value, the program returns to read a new P-L value 318. If the new P-L value is within 0.1 degree of the desired P-L value, the program increments the antenna address 338 and checks to see if the antenna number is n+1 340. If the antenna number is not n+1, the program returns to activate the antenna address 316. If the antenna number is n+1, the program returns to the selection screen 342.

If the one of eight options 218 chosen was not any of the options 1 through 4, then the program will test to see if option 5 was selected 344. If option 5 (Exit Program) was selected, then the program branches to the option 5 routine. Option 5 proceeds to display the exit statement 346 and stop the program 348.

If the one of eight options 218 chosen was not any of the options 1 through 5, then the program will test to see if option 6 was selected 350. If option 6 (reserved for future program—Initiate Auto EZ Optimizer) was selected, then the program branches to the option 6 routine. Option 6 is reserved for a future routine 352 whereby the antennas can be monitored and adjusted by way of the internet, intranet, or other modem based communication means.

If the one of eight options 218 chosen was not any of the options 1 through 6, then the program will test to see if option 7 was selected 354. If option 7 (reserved for future program—Adjust Electronic Tilt) was selected, then the program branches to the option 7 routine. Option 7 is reserved for a future routine 356 that will allow the operator to adjust an antenna that has an internal electronic tilt system.

If the one of eight options 218 chosen was not any of the options 1 through 7, then the program will test to see if option 8 was selected 358. If option 8 (Adjust Sector CH) was selected, then the program branches to the option 8 routine. Option 8 proceeds to prompt the user to select the sector 364, actuate the address of the selected sector 366, read a new CH from the electronic compass, and display the CH 368. The routine then prompts the user for a desired CH 370, and tests to see if the new CH is smaller than the desired CH 372. If the new CH is smaller than the desired CH, the program branches to actuate the CH actuator motor in a reverse direction 376 before proceeding to the next operation. Or, if the new CH is not smaller than the desired CH, the program continues to actuate the CH actuator motor in a forward direction 374. The program reads a new CH 378 and checks to see if the new CH is within 0.1 degree of the desired CH 380. If the answer is no, the program returns to get another new CH 378. If the answer is yes, the routine stops 382. If option 8 was not selected 358, the program proceeds to try again by prompting the user for a new option 362.

What is claimed is:

1. An antenna alignment system comprising:

at least one antenna having an antenna heading and an antenna elevation angle;

a compass in mechanical cooperation with the antenna, wherein the compass is adapted to provide an antenna heading measurement;

a plumb-to-level transducer in mechanical cooperation with the antenna, wherein the plumb-to-level transducer is adapted to provide an antenna elevation angle measurement;

a compass heading actuator adapted to change the antenna heading;

a plumb-to-level actuator adapted to change the antenna elevation angle;

a remote site; and an interconnection electrically connecting the compass, the plumb-to-level transducer, the compass heading actuator, and the plumb-to-level actuator, to the remote site, wherein the remote site includes a desired plumb-to-level value and a desired compass heading value, and wherein the remote site is adapted to cooperate with the compass heading actuator and the plumb-to-level actuator over the interconnection to obtain the desired plumb-to-level value and the desired compass heading value by comparing the desired plumb-to-level value to the antenna elevation angle measurement and desired compass heading value to the antenna heading measurement.

2. The system set forth in claim 1, wherein said antenna resides on a tower.

3. The system set forth in claim 1, wherein plumb-to-level transducer is adapted to measure the antenna attitude with respect to true vertical.

4. The system set forth in claim 1, wherein the compass is adapted to measure the antenna attitude with respect to magnetic north.

5. The antenna alignment system of claim 1, wherein the interconnection includes an interconnection cable.

6. The antenna alignment system of claim 1, wherein the at least one antenna comprises a plurality of antennas, and wherein the plurality of antennas comprises a sector, and wherein the sector defines a sector heading, wherein:

the compass is adapted to provide a sector heading measurement, and the compass heading actuator is adapted to change the sector heading;

the plumb-to-level transducer comprises a plurality of plumb-to-level transducers and the antenna elevation angle comprises a plurality of antenna elevation angles;

each of the plurality of plumb-to-level transducers mechanically cooperates with a respective one of the plurality of antennas to provide a respective plurality of antenna elevation angle measurements;

the plumb-to-level actuator comprises a plurality of plumb-to-level actuators adapted to change the respective one of the antenna elevation angles of the respective one of the plurality of antennas; and the desired plumb-to-level value comprises a plurality of desired plumb-to-level values, wherein the remote site is adapted to cooperate with the plurality of plumb-to-level actuators over the interconnection to obtain the plurality of desired plumb-to-level values by comparing the plurality of desired plumb-to-level values to the plurality of antenna elevation angle measurements.

7. The antenna alignment system of claim 1, wherein the at least one antenna comprises a plurality of antennas, and wherein the plurality of antennas comprises a sector, and wherein:

the plumb-to-level transducer comprises a plurality of plumb-to-level transducers;

the antenna elevation angle comprises a plurality of antenna elevation angles;

the plumb-to-level actuator comprises a plurality of plumb-to-level actuators;

the desired plumb-to-level value comprises a plurality of desired plumb-to-level values;

the compass comprises a plurality of compasses;

the antenna heading comprises a plurality of antenna headings;

the compass heading actuator comprises a plurality of compass heading actuators; and the desired compass heading value comprises a plurality of desired compass heading values;

wherein the plurality of plumb-to-level transducers, the plurality of antenna elevation angles, the plurality of plumb-to-level actuators, the plurality of desired plumb-to-level values, the plurality of compasses, the plurality of antenna headings, the plurality of compass heading actuators, and the plurality of desired compass heading values are associated with respective ones of the plurality of antennas, and wherein the remote site is adapted to cooperate with the plurality of compass heading actuators and the plurality of plumb-to-level actuators over the interconnection to obtain the plurality of desired plumb-to-level values and the plurality of desired compass heading values by comparing the plurality of desired plumb-to-level values to the plurality of antenna elevation angle measurements, and plurality of desired compass heading values to the plurality of antenna heading measurements.

8. The antenna alignment system of claim 1, wherein the interconnection is adapted to carry the antenna heading measurement and the antenna elevation angle measurement from the antenna to the remote site.

9. The antenna alignment system of claim 8, wherein the interconnection is further adapted to carry a power signal to the compass heading actuator and to the plumb-to-level actuator.

10. The antenna alignment system of claim 8, further including a computer interface, wherein the computer interface is adapted to:

provide signals compatible with a computer; and receive compass heading actuator commands and plumb-to-level actuator commands from the computer.

11. The antenna alignment system of claim 10, wherein the computer interface is adapted to be disconnectably electrically connectable to the computer.

12. The antenna alignment system of claim 10, wherein the computer comprises at least one selected from the group consisting of a laptop computer, a desktop computer, and a mainframe computer.

13. The antenna alignment system of claim 10, wherein the remote site includes a field interconnection box at the base of an antenna tower, and wherein the computer interface resides in the field interconnection box.

14. The antenna alignment system of claim 1, further including computers located at other sites, wherein the interconnection includes a modem for connecting to the other sites.

15. The antenna alignment system of claim 1, wherein the compass comprises an electronic compass.

16. The antenna alignment system of claim 1, wherein:

the antenna heading measurement and the antenna elevation angle measurement are converted to digital signals by an upper field box located proximal to the antenna; and the digital signals are carried by the interconnect to a lower field box at the remote site.

17. A method for adjusting antenna elevation angle and heading for an antenna system including a plumb-to-level actuator and a compass heading actuator, the method comprising:

measuring an antenna elevation angle relative to true vertical to generate an antenna elevation angle measurement;

measuring an antenna heading relative to true magnetic north to generate an antenna heading measurement;

providing the antenna elevation angle measurement and the antenna heading measurement to a remote site over an interconnection;

comparing a desired plumb-to-level value to the antenna elevation angle measurement to generate a plumb-to-level actuator direction;

actuating the plumb-to-level actuator in the plumb-to-level actuator direction;

comparing a desired compass heading value to the antenna heading measurement to generate a compass heading actuator direction; and actuating the compass heading actuator in the compass heading actuator direction.

18. The method of claim 17, wherein:

comparing a desired plumb-to-level value to the antenna elevation angle measurement comprises executing a program to determine if the antenna elevation angle measurement is within 0.1 degrees of the desired plumb-to-level value; and comparing a desired compass heading value to the antenna heading measurement comprises executing a program to determine if the antenna heading measurement is within 0.1 degrees of the desired compass heading value.

19. An antenna heading alignment system comprising:

an antenna having an antenna heading and an antenna elevation angle;

at least one of a group consisting of:

a compass in mechanical cooperation with the antenna, wherein the compass is adapted to provide an antenna heading measurement, and a compass heading actuator adapted to change the antenna heading; and a plumb-to-level transducer in mechanical cooperation with the antenna, wherein the plumb-to-level transducer is adapted to provide an antenna elevation angle measurement, and a plumb-to-level actuator adapted to change the antenna elevation angle, a remote site; and an interconnection between the antenna and the remote site, wherein the remote site includes at least one of a group consisting of:

a desired plumb-to-level value, wherein the remote site is adapted to cooperate with the plumb-to-level actuator over the interconnection to obtain the desired plumb-to-level value by comparing the desired plumb-to-level value to the antenna elevation angle measurement; and a desired compass heading value, wherein the remote site is adapted to cooperate with the compass heading actuator over the interconnection to obtain the desired compass heading value by comparing the desired compass heading value to the antenna heading measurement.

20. The antenna heading alignment system of claim 19, wherein the antenna is a phased array antenna.

* * * * *